United States Patent [19]

Vanmaele et al.

[11] Patent Number: 4,855,223

[45] Date of Patent: Aug. 8, 1989

[54] ORGANIC COMPOUNDS FOR USE IN A DYE DIFFUSION TRANSFER PROCESS AND PHOTOGRAPHIC ELEMENTS INCORPORATING THEM

[75] Inventors: Luc J. Vanmaele, Lochristi; Janssens Wilhelmus, Aarschot; Christian C. Van de Sande, Belsele, all of Belgium

[73] Assignee: Agfa-Gevaert, N.V., Mortsel, Belgium

[21] Appl. No.: 166,028

[22] Filed: Mar. 9, 1988

[30] Foreign Application Priority Data

Mar. 19, 1987 [EP] European Pat. Off. ..... 87200506.1

[51] Int. Cl.[4] ..... G03C 5/54; G03C 7/26

[52] U.S. Cl. ..... 430/562; 430/223

[58] Field of Search ..... 430/562, 223

[56] References Cited

U.S. PATENT DOCUMENTS

| | | | |
|---|---|---|---|
| 3,954,476 | 5/1976 | Krutak et al. | 430/223 |
| 4,110,113 | 8/1978 | Melzer et al. | 430/223 |
| 4,524,124 | 6/1985 | Bergthaller et al. | 430/223 |
| 4,605,613 | 8/1986 | Van de Sande et al. | 430/223 |
| 4,777,124 | 10/1988 | Vanmaele et al. | 430/223 |

*Primary Examiner*—Richard L. Schilling
*Attorney, Agent, or Firm*—A. W. Breiner

[57] ABSTRACT

A photographic silver halide emulsion material for carrying out a dye diffusion transfer process which material contains a compound that is capable of releasing a diffusible light-fast azo dye from a non-diffusible carrier moiety, wherein said dye contains the following group: $—Ar^1—SO_2NR—Ar^2—NR—SO_2—$ as defined herein.

9 Claims, No Drawings

ORGANIC COMPOUNDS FOR USE IN A DYE DIFFUSION TRANSFER PROCESS AND PHOTOGRAPHIC ELEMENTS INCORPORATING THEM

DESCRIPTION

The present invention relates to organic compounds for use in a dye diffusion transfer process and photographic elements incorporating them.

Important non-conventional multicolor reproduction systems are based on dye diffusion transfer processing. These systems are of particular value for reasons of simplicity of processing and rapidity of access to the colour image.

Day diffusion transfer imaging can be carried out in a number of ways but each system is based on the same principle, namely the alteration of the solubility of dyes controlled by the development of the photographic silver image.

In commonly known dye diffusion transfer processes the dye-image-producing compounds are (A) initially mobile in alkaline aqueous media and become immobilized during processing, or (B) they are initially immobile and are mobilized during processing.

A survey of such processes is given by Christian C. Van de Sande in Angew. Chem. Int. Ed. Engl. 22 (1983) 191–209.

Known compounds for use in a dye diffusion transfer process include e.g. triphenylmethane, xanthene, azo, azomethine, anthraquinone, alizarine, merocyanine, quinoline or cyadine dye structures. Of particularly frequent use is a mozo-azo-dye group (ref. e.g. U.S Pat. No. 3,725,062).

Redox-controlled dye-releasing compounds are introduced in commercial systems and are known various sources.

Oxidizable dye-releasing compounds that after oxidation release a dye moiety by hydrolysis are known, e.g., from DE-A No. 2,242,762, DE-A No. 2,406,664, DE-A No. 2,505,246, DE-A No. 2,613,005, DE-A No. 2,645,656 (DE-A stands for German Auslegeschrift) and Research Disclosure publications Nos. 15,157 (November 1976), 16,654 (April 1977) and 17,736 (January 1979).

In these references dye-releasing compounds are described in which the dye moiety is linked most frequently to an oxidizable carrier moiety through a sulphonamido group. The dye released from such compounds contains a sulphamoyl group.

Oxidizable dye-releasing compounds which in oxidized form release a dye moiety by intramolecular displacement reaction are described, e.g., in U.S. Pat. No. 3,443,940. The dye released from these compounds contains a sulphinate group.

It is particularly interesting in dye diffusion transfer to operate with dye-releasing compounds the dye release from which is inversely proportional to the development of a negative-working silver halide emulsion layer and whereby positive dye images can be formed in a receptor material.

Oxidizable dye-releasing compounds that in oxidized form are stable but in reduced state set free a dye moiety by an elimination reaction are described in DE-A No. 2,823,159 and DE-A No. 2,854,946. Compounds of that type when used in reduced form in an unexposed silver halide emulsion material are called IHO-compounds wherein IHO is the acronym for "inhibited hydrolysis by oxidation". When used in the oxidized form these compounds are called IHR-compounds, wherein IHR is the acronym for "increased hydrolysis by reduction".

Reducible quinonoid IHR-compounds which after reduction can undergo a dye release with an intermolecular nucleophilic displacement reaction are described in DE-A No. 2,809,716 wherein these compounds are called BEND-compounds, BEND standing for "Ballasted Electron-accepting Nucleophilic Displacement".

Reducible IHR-compounds which after reduction can undergo a dye release with an elimination reaction are described in the published EP-A No. 0,004,399 and in the U.S. Pat. No. 4,371,604.

Other classes of compounds that may release a dye after reduction are described in DE-A No. 3,008,588 and DE-A No. 3,014,669.

Particularly useful are redox-controlled dye-releasing compounds according to the general formula:

BAL—REDOX—DYE wherein:

BAL represents a moiety with ballast residue for immobilizing the dye-releasing compound in a hydrophilic colloid layer, REDOX represents a redox-active group, i.e. a group that under the circumstances of alkaline silver halide development is oxidizable or reducible and depending on the oxidized or reduced state yields a dye release by an elimination reaction, nucleophilic displacement reaction, hydrolysis or cleavage reaction, DYE represents a diffusible dye moiety or a precursor thereof.

It is a requirement that the dyes forming the photographic image have a sufficient stability against visible light. Azo dyes belong to the group of dyes that have a favourable stability in that respect but improvements are still desirable.

Stability against light of azo dyes has been improved by forming complex-compounds with metal ions as described e.g. in U.S Pat. Nos. 4,207,104 and 4,357,412. The metal ions can be present in the image-receiving layer itself or in a layer adjacent thereto, or the image-receiving layer can be contacted with metal ions in a bath after diffusion of the dye has taken place. Metal ions suited for complexing with particular azo dyes are polyvalent metal ions such as cooper(II), zinc(II), nickel(II), cobalt(II), platinum(II), or palladium(II). The use of said ions adds to the cost of the imaging system and makes it ecologically less attractive.

According to an other method described in published EP-A No. 0173361 stability against light of azo dyes released from a carrier moiety as a function of a redox-reaction or argentolytic reaction has been improved by chemically linking a cleavable group and the releasable azo dye part with a bivalent organic group incorporating at least three aromatic nuclei.

It is one of the objects of the present invention to provide new compounds for use in a photographic dye diffusion transfer process wherein said compounds yield dye images with improved stability against light without need for complexing polyvalent metal ions.

It is more particularly one of the objects of the present invention to provide new compounds that are capable of releasing a diffusible azo dye in function of a rodex-reaction taking place in the development of a silver halide emulsion layer under alkaline conditions, and that have an improved stability against light by the presence in the releasable dye part of a special non-chromophoric organic group.

It is another object of the present invention to provide a photographic silver halide emulsion material incorporating said compounds in non-diffusing state for image-wise release of a diffusible azo dye in a dye-diffusion transfer process.

In accordance with the present invention compounds are provided that are capable of releasing a diffusible azo dye from a carrier moiety by a redox-reaction which compounds correspond to the following general formula (I):

$$CAR—L—G—D \quad (I)$$

wherein:

CAR represents an organic moiety capable of undergoing a redox-reaction, e.g. a hydroquinone type or quinone type moiety examples of which are described hereinafter, L represents a chemical group cleavable or releasable from the carrier moiety by a redox-reaction which takes place under alkaline conditions, G represents a bivalent organic linking group, and D is an azo dye part directly chemically linked to G, characterised in that said compound comprises in its structure a group $—Ar^1—SO_2NR—Ar^2—NRSO_2—$ so that:

(1) the group $—Ar^1—SO_2NR—Ar^2—NRSO_2—$ is the bivalent organic linking group G, wherein the $Ar^1$ group is directly linked to L and wherein between its $SO_2$ end group and an azo-group of the dye part D only one bivalent aromatic nucleus or bivalent condensed aromatic nucleus, which nuclei may be substituted, is present, and wherein in said group $—Ar^1—SO_2N-R—Ar^2—NRSO_2—$ R is hydrogen or an alkyl group, e.g. methyl, and each of $Ar^1$ and $Ar^2$—same or different—represents a bivalent aromatic nucleus, e.g. phenylene nucleus, including said bivalent aromatic nucleus in substituted state, e.g. substituted with substituents selected from the group consisting of alkyl, e.g. methyl, halogen, e.g. chlorine or bromine, nitro, —cyano, $—OR^3$ or $—SR^3$ wherein $R^3$ represents alkyl or aryl, e.g. methoxy or phenoxy, and the group $—NR^4R^5$, wherein $R^4$ and $R^5$ represent a same or different alkyl group, e.g. methyl or ethyl group, or represent together the necessary atoms to close a nitrogen containing heterocyclic nucleus, e.g. morpholino nucleus, and/or (2) said group $—Ar^1—SO_2NR—Ar^2—NRSO_2—$ is linked directly through its first group $Ar^1$ to an azo-group (—N=N—) of the dye part D, and through its $SO_2$ end group is linked to a group $R^6$ which represents hydrogen or an alkyl group, the groups $Ar^1$, $Ar^2$ and R having the same definition as given in point (1) above.

Suitable organic bivalent linking groups other than those given in point (1) above are mentioned in U.S. Pat. Nos. 4,232,107, 4,371,604, 4,477,554 and 4,605,613 and in published EP-A No. 0 219 892 corresponding with U.S. patent application Ser. No. 06/916,932 and in published EP-A No. 0 235 858 corresponding with U.S. pat. application Ser. No. 07/016,100 now U.S. Pat. No. 4,777,129.

Particularly useful compounds according to the present invention correspond to the following general formula (II):

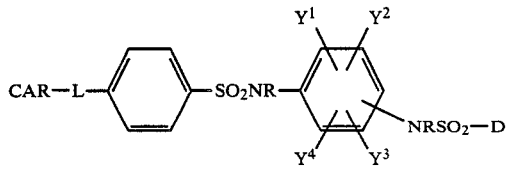

(II)

wherein:

CAR has the meaning as defined above in general formula (I),

L is —O—, —S—, $—SO_2—$, $—NR^1SO_2—$, $—NR^1CO—$, $—NR^1—$ or a $—N^+R^1R^2—.(X^-)$ group, wherein each of $R^1$ and $R^2$—same or different when being both present—is hydrogen, an alkyl group, a substituted alkyl group, an aryl group or a substituted aryl group, and $X^-$ is an anion, $Y^1$, $Y^2$, $Y^3$ and $Y^4$—same or different—is hydrogen or a substituent selected from the group consisting of alkyl, halogen, e.g. chlorine or bromine, $—OR^3$ or $—SR^3$ wherein $R^3$ represents alkyl or aryl, e.g. methoxy or phenoxy, and the group $—NR^4R^5$, wherein $R^4$ and $R^5$ represent a same or different alkyl group, e.g. methyl or ethyl group, or represent together the necessary atoms to close a nitrogen containing heterocyclic nucleus, R is hydrogen or an alkyl group, e.g. a methyl group, the substituents $—SO_2NR—$ and $—NRSO_2$ being preferably situated in ortho- or para-position with respect to each other, and D is an azo dye part either or not substituted by the group $—Ar^1—SO_2NR—Ar^2—NR—SO_2—R^6$ as defined above in connection with general formula (I).

Preferred mono-azo dye releasing compounds are within the scope of the following general formula (III):

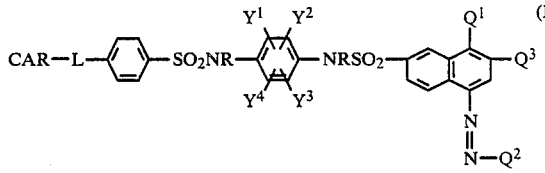

(III)

wherein:

$Q^1$ is OH or hydrolysable precursor thereof, $—NH_2$, $—NHSO_2R^{10}$, $—NHCOR^{10}$ wherein $R^{10}$ is alkyl, e.g. methyl, $Q^2$ is an aryl group or a substituted aryl group, a heterocyclic group or a substituted heterocyclic group, wherein said group $Q^2$ is preferably the already mentioned group $—Ar^1—SO_2NR—Ar^2—NRSO_2—R^6$ wherein $Ar^1$ is directly linked to the —N=N— group, $Y^1$, $Y^2$, $Y^3$ and $Y^4$—same or different—is hydrogen or a substituent selected from the group consisting of alkyl, halogen, e.g. chlorine or bromine, $—OR^3$ or $—SR^3$ wherein $R^3$ represents alkyl or aryl, e.g. methoxy or phenoxy, and the group $—NR^4R^5$, wherein $R^4$ and $R^5$ represents a same or different alkyl group, e.g. methyl or ethyl group, or represent together the necessary atoms to close a nitrogen containing heterocyclic nucleus, $Q^3$ is H, $—SO_3H$, —COOH, hydrolysable derivatives thereof or salts thereof, $—CONR^{11}R^{12}$, $—SO_2NR^{11}R^{12}$, $—NR^{11}COR^{12}$, $—NR^{11}SO_2R^{12}$, $—COR^{13}$, $—SO_2R^{13}$, wherein each of $R^{11}$, $R^{12}$ and $R^{13}$—same or different—is hydrogen, an alkyl group, a substituted alkyl group, an aryl group or a substituted aryl group or $R^{11}$ and $R^{12}$ together form a heterocyclic ring, and wherein the other symbols CAR— and —L— have the meaning described above in general formula (I), —L— preferably being $—SO_2—$.

Examples of carrier moieties including the group L, i.e. (CAR—L—), wherefrom in oxidized form a dye moiety is split off are given hereinafter.

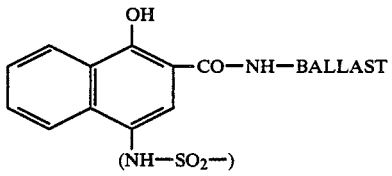

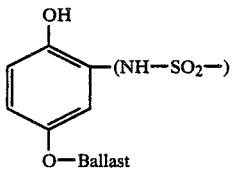

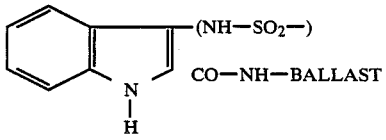

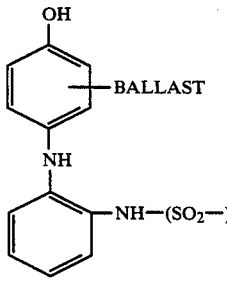

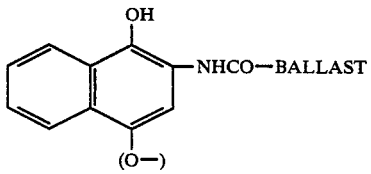

The groups within brackets are released together with the dye moiety (not represented), and remain as diffusion promoting groups with the dye moiety.

In the above mentioned dye-releasing compounds the dye release proceeds directly proportional to the rate of formation of the oxidation products of developing agent used in the development of silver halide. Said compounds are therefore negative working in that they undergo dye release in correspondence with the exposed portions of a negative working silver halide emulsion layer. For the production of positive pictures an image reversal is needed which may be based on the use of positive-working layers containing a direct-positive silver halide emulsion or on the silver salt complex diffusion transfer process by selecting a proper layer assemblage as described, e.g., in European Patent No. 0,003,376.

Examples of carrier moieties including the group L, i.e. (CAR—L—), wherefrom in reduced state a dye moiety can be set free are the following:

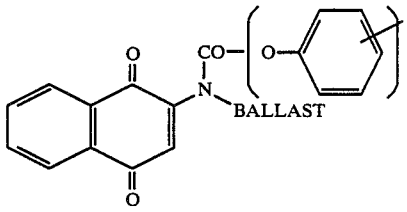

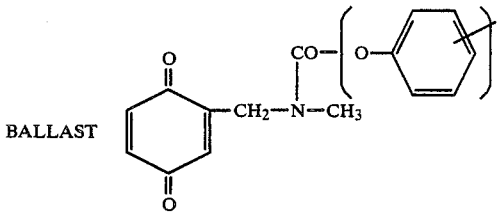

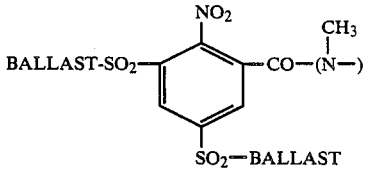

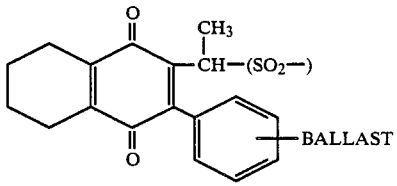

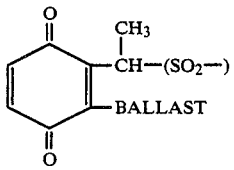

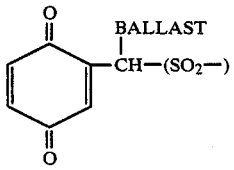

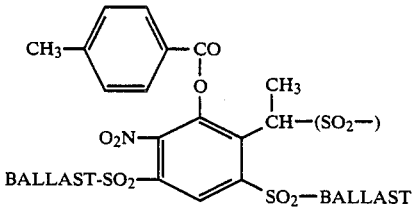

-continued

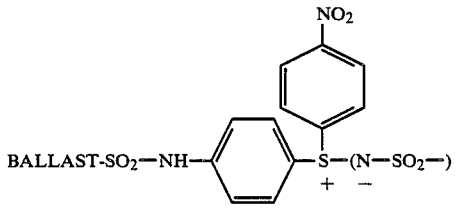

The above groups within brackets are functional groups that are split off together with the dye moiety. These functional groups can be separated from the chromophoric group of the dye by a linking member having no influence on the absorption properties of the dye. The functional group, however, optionally together with said linking member, may be of importance to determine the diffusion-mobility and/or capability of the released dye to be mordanted. Useful linking members are, e.g., alkylene and arylene groups.

Ballast residues (BALLAST) that confer diffusion resistance are residues which allow the compounds according to the invention to be incorporated in a non-diffusing form in the hydrophilic colloids normally used in photographic materials. Organic residues, which generally carry straight- or branched-chain aliphatic groups and also isocyclic or heterocyclic or aromatic groups mostly having from 8 to 20 carbon atoms are preferred for this purpose. These residues are attached to the remainder of the molecule either directly or indirectly, e.g. through one of the following groups: —NH-CO—; —NHSO$_2$—; —NR—; in which R represents hydrogen or alkyl; —O—; —S—; or —SO$_2$—. The residue which confers diffusion resistance may in addition carry groups which confer solubility in water, e.g. sulpho groups or carboxyl groups, and these may also be present in anionic form. Since the diffusion properties depend on the molecular size of the compound as a whole, it is sufficient in some cases, e.g., if the entire molecule is large enough, to dispense with ballasting substituents or to use one or more shorter-chain groups as groups conferring resistance to diffusion.

In a preferred embodiment for positive dye image production with negative working silver halide emulsions the above groups D in general formulae (I) and (II) form part of the already mentioned dye releasing quinonoid IHR-compounds wherefrom a diffusible dye moiety is released by reduction and hydrolysis.

The reaction operative in the release of a dye moiety from said quinonoid IHR-compounds proceeds in two stages illustrated by the following equations:

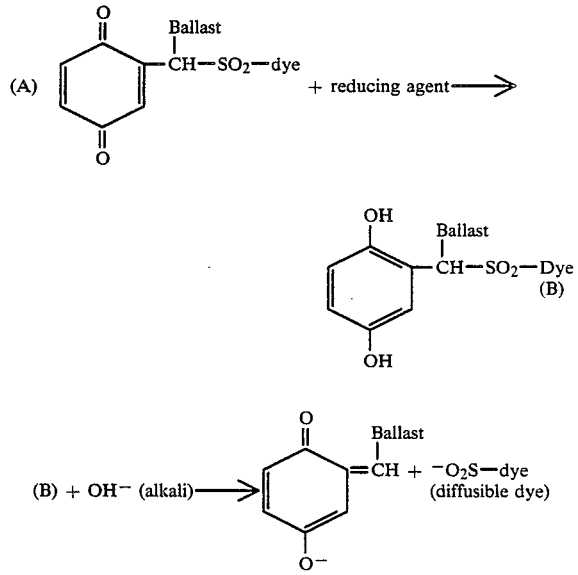

wherein:

"BALLAST" stands for a ballasting group making the compound non-diffusing in a hydrophilic colloid medium under wet alkaline conditions.

The terminology "diffusing" in this invention denotes materials having the property of diffusing effectively through the colloid layers of the photographic elements in alkaline liquid medium. "Mobile" has the same meaning. The terms "non-diffusing" and "immobile" have the converse meaning.

Particularly suited quinonoide type carrier groups (CAR) correspond to the following structural formulae listed in Table 1.

TABLE 1

| | |
|---|---|
| CAR 1 | 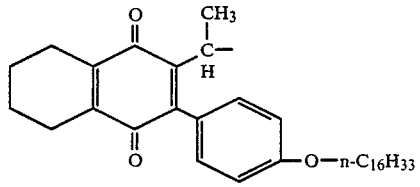 |
| CAR 2 | 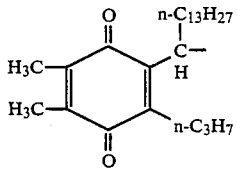 |

These carrier groups and other particularly useful carrier groups are described in published EP-A Nos. 0 004 399, 0 038 092, 0 109 701 and in U.S. Pat. No. 4 273 855.

Particularly suited dye parts D correspond to the following structural formulae listed in Table 2.

TABLE 2
| No. | Structural formula of D | Type of compound |
|---|---|---|
| C1 | 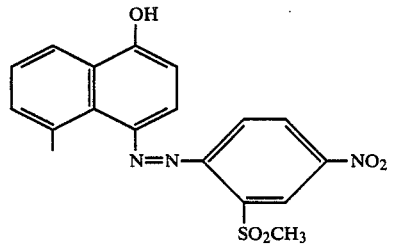 | cyan dye residue |
| Y1 | 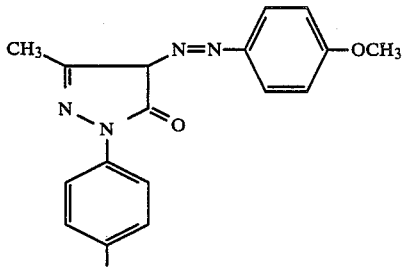 | yellow dye residue |
| Y2 | 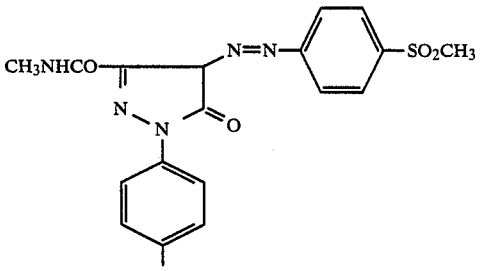 | yellow dye residue |
| M1 | 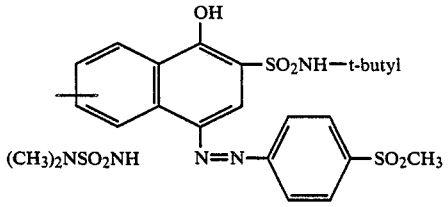 | magenta dye residue |
| C2 | 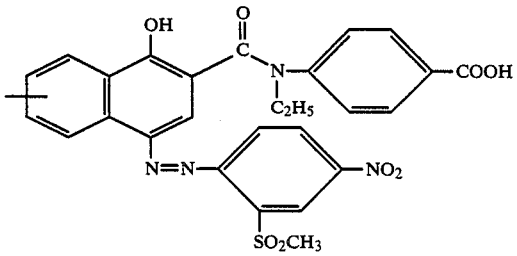 | cyan dye residue |

TABLE 2-continued

| No. | Structural formula of D | Type of compound |
|---|---|---|
| C3 | 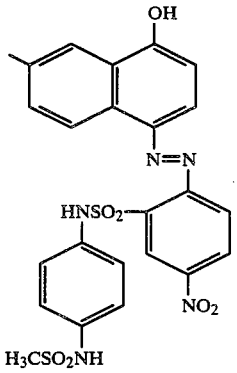 | cyan dye residue |
| M2 | 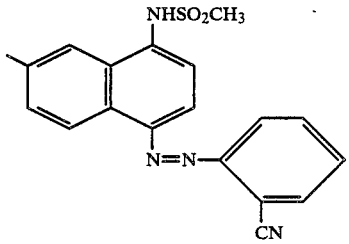 | magenta dye residue |

Other suitable dye parts are disclosed in published EP-A 0121 930.

For the synthesis of compounds containing such dye part groups D reference is made to e.g. U.S. Pat. Nos. 3,929,760, 3,954,476, 4,225,708, 4,256,831, and European Patent No. 0 004 399.

Examples of particularly suitable mono-azo dye IHR-compounds for use according to the present are mentioned in the following Table 3.

TABLE 3

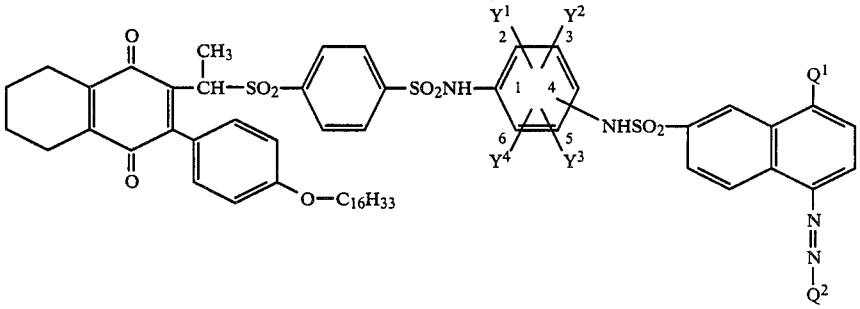

| No. | Position $Y^1$ | $Y^2$ | $Y^3$ | $Y_4$ | $Q^1$ | Position $-NHSO_2-$ | $Q^2$ |
|---|---|---|---|---|---|---|---|
| I | 2-H | 3-H | 5-H | 6-H | OH | 4 | 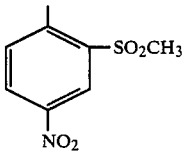 |
| II | 2-H | 3-H | 5-H | 6-H | OH | 4 | 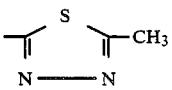 |
| III | 2-H | 3-H | 5-H | 6-H | $NHSO_2CH_3$ | 4 | 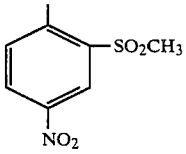 |

TABLE 3-continued
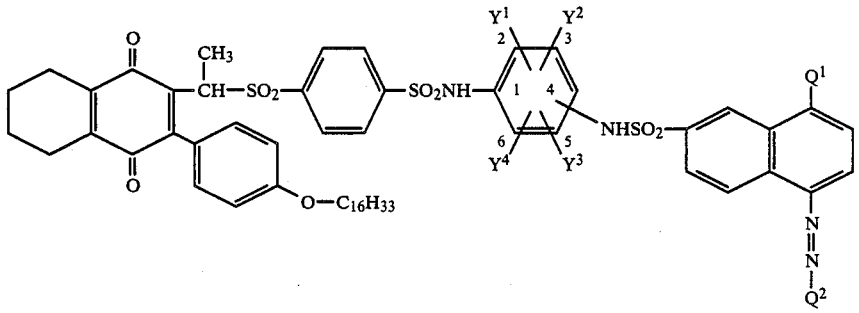
| No. | Position $Y^1$ | $Y^2$ | $Y^3$ | $Y_4$ | $Q^1$ | Position —$NHSO_2$— | $Q^2$ |
|---|---|---|---|---|---|---|---|
| IV | 2-H | 3-H | 5-H | 6-H | OH | 4 | 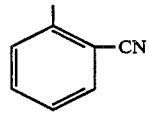 |
| V | 2-H | 3-H | 5-H | 6-H | " | 4 | 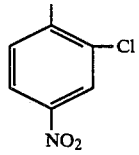 |
| VI | 2-H | 3-H | 5-H | 6-H | " | 4 | 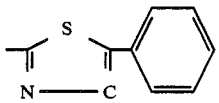 |
| VII | 2-H | 3-H | 5-H | 6-H | $NHSO_2CH_3$ | 4 | 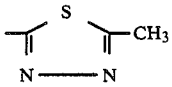 |
| VIII | 2-H | 3-H | 5-H | 6-H | " | 4 | 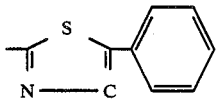 |
| IX | 2-H | 4-H | 5-H | 6-H | OH | 3 | 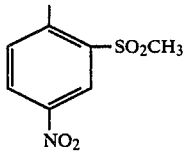 |
| X | 3-H | 4-H | 5-H | 6-H | " | 2 | 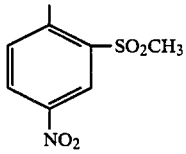 |
| XI | 3-H | 4-H | 5-H | 6-H | " | 2 | 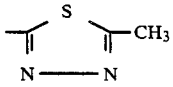 |

TABLE 3-continued
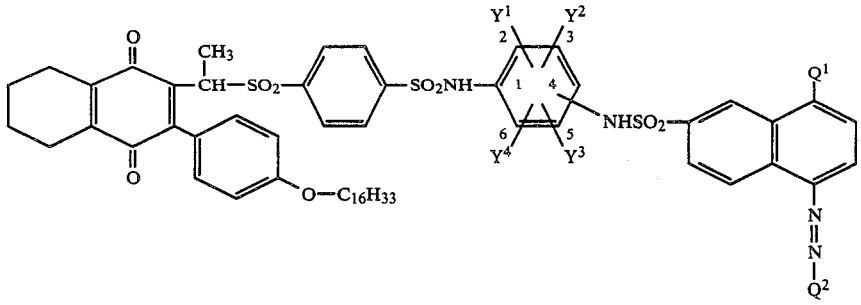
| No. | Position $Y^1$ | $Y^2$ | $Y^3$ | $Y_4$ | $Q^1$ | Position $-NHSO_2-$ | $Q^2$ |
|---|---|---|---|---|---|---|---|
| XII | 6-$CH_3$ | 2-H | 3-H | 5-H | OH | 4 | 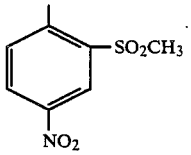 |
| XIII | 5-$CH_3$ | 2-H | 3-H | 6-H | OH | 4 | " |
| XIV | 6-$CH_3$ | 2-H | 3-H | 5-H | OH | 4 | 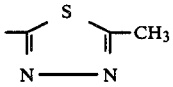 |
| XV | 5-$CH_3$ | 2-H | 3-H | 6-H | OH | 4 | " |
| XVI | 2,3,5,6-$CH_3$ | | | | OH | 4 | 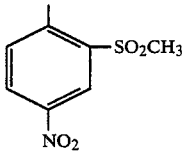 |
| XVII | 2-H | 4-H | 5-H | 6-H | OH | 3 | 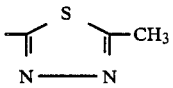 |
| XVIII | 2-H | 3-H | 5-H | 6-$N(CH_3)_2$ | OH | 4 | 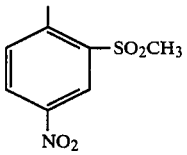 |
| XIX | 2-H | 3-H | 5-H | 6-$N(CH_3)_2$ | OH | 4 | 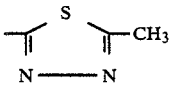 |
| XX | 2-H | 3-H | 5-H | 6-$N(CH_3)_2$ | OH | | 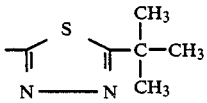 |
| XXI | 2-H | 3-H | 5-$N(CH_3)_2$ | 6-H | OH | 4 | 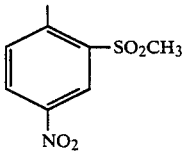 |

TABLE 3-continued
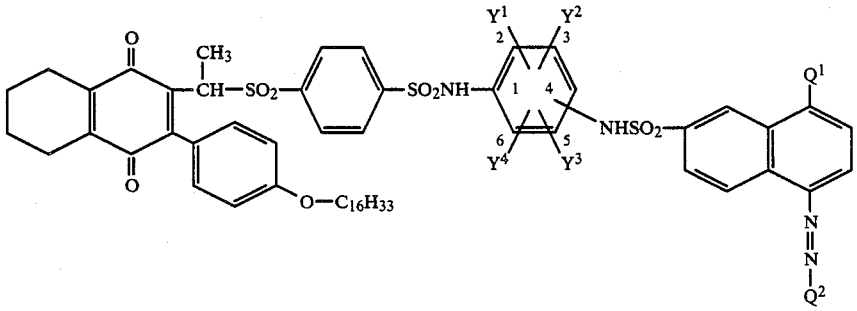
| No. | Position $Y^1$ | $Y^2$ | $Y^3$ | $Y_4$ | $Q^1$ | Position —$NHSO_2$— | $Q^2$ |
|---|---|---|---|---|---|---|---|
| XXII | 2-H | 3-H | 5-$N(CH_3)_2$ | 6-H | OH | 4 | 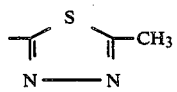 |
| XXIII | 2-H | 3-H | 5-$N(CH_3)_2$ | 6-H | OH | 4 | 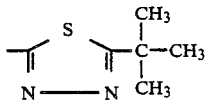 |
| XXIV | 2-H | 3-H | 5-H | 6-H | OH | 4 | 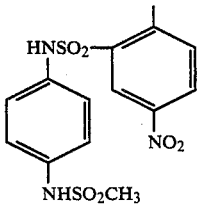 |
| XXV | 2-H | 3-H | 5-$CH_3$ | 6-H | OH | 4 | 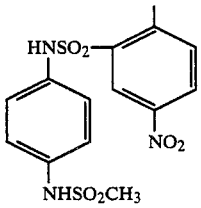 |
| XXVI | 2-H | 3-H | 5-H | 6-H | OH | 4 | 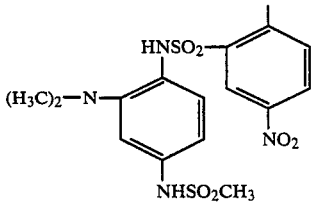 |
| XXVII | 2-H | 3-H | 5-H | 6-H | OH | 4 | 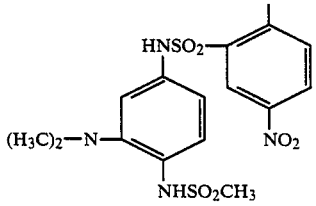 |

TABLE 3-continued
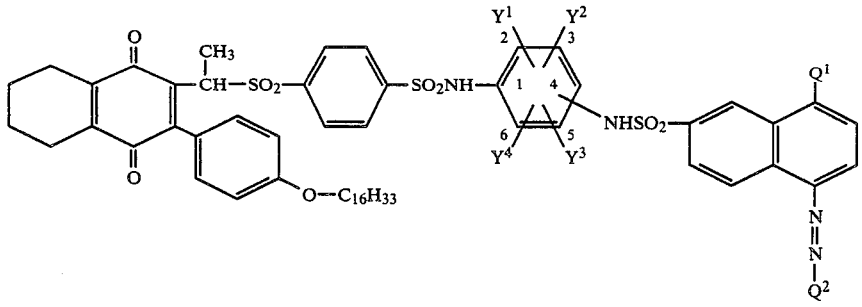
| No. | Position $Y^1$ | $Y^2$ | $Y^3$ | $Y_4$ | $Q^1$ | Position $-NHSO_2-$ | $Q^2$ |
|---|---|---|---|---|---|---|---|
| XXVIII | 2-H | 3-H | 5-$CH_3$ | 6-H | OH | 4 | 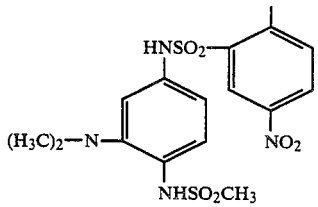 |
| XXIX | 2-H | 3-H | 5-$CH_3$ | 6-H | OH | 4 | 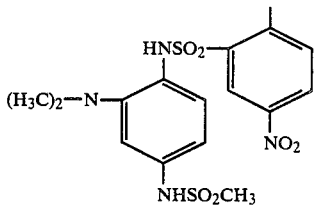 |
| XXX | 2-H | 3-H | 5-H | 6-H | OH | 4 | 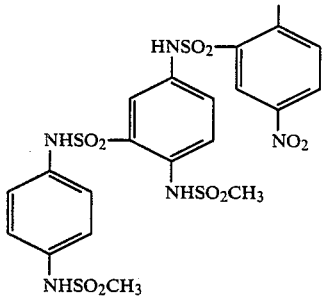 |
| XXXI | 2-H | 3-H | 5-$CH_3$ | 6-H | OH | 4 | 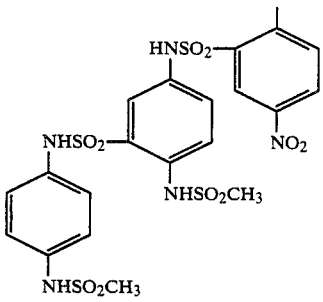 |
The preparation of compounds I, II, III, XII, XVII, XVIII, XIX, XXI, XXIII, and XXIV of Table 3 is given hereinafter for illustrative purposes.
Preparation of compound I of Table 3.
Reaction scheme:
Step 1

-continued
Reaction scheme:
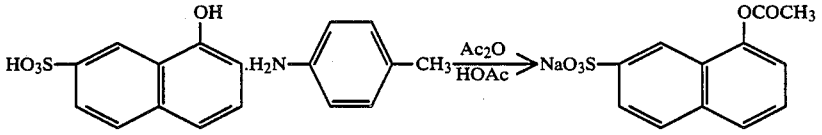
(1) (2)
$Ac_2O$ = acetic anhydride
HOAc = acetic acid
Step 2
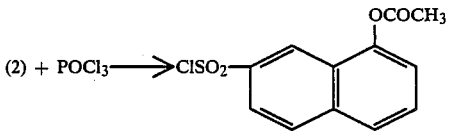
(3)
Step 3
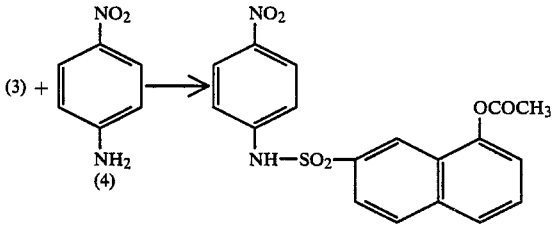
(5)
Step 4
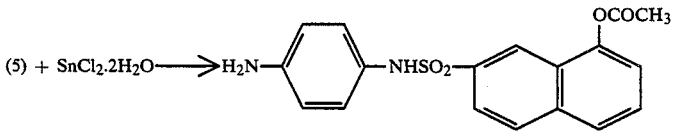
(6)
Step 5
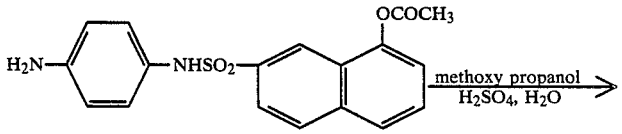
(6)
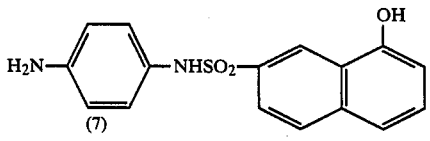
(7)
Step 6
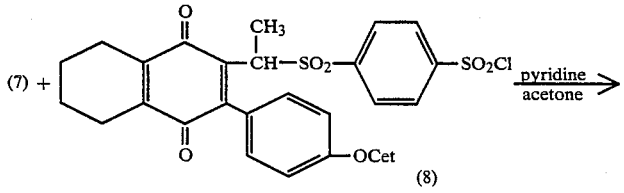
(8)

-continued

Reaction scheme:

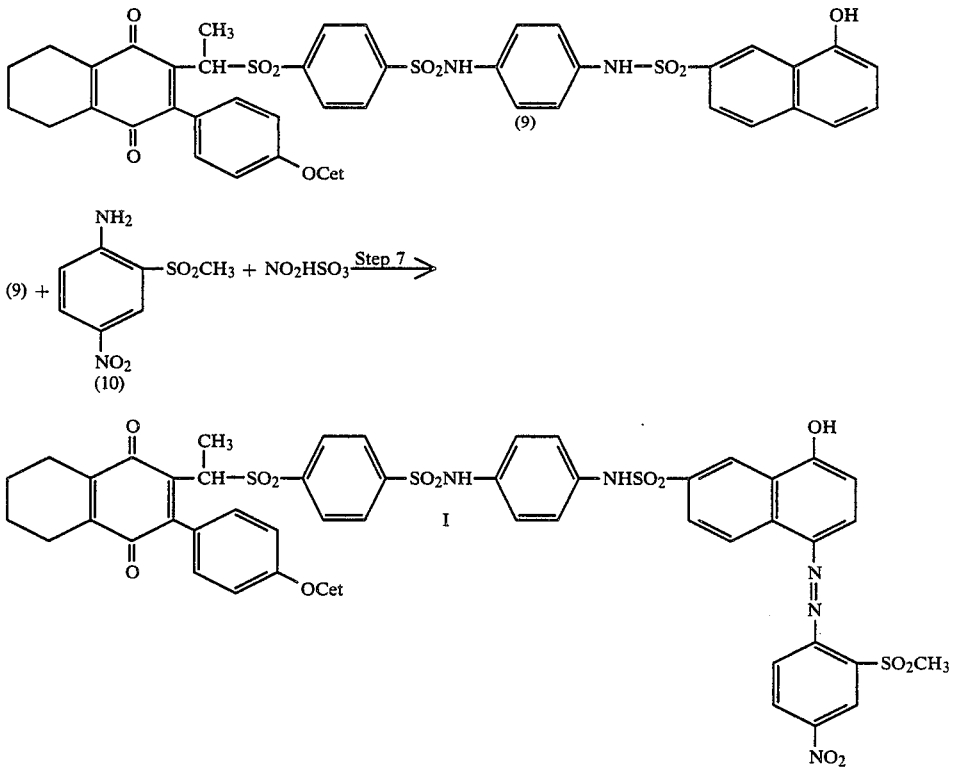

Cet = n-hexadecyl 495 g of compound (1) and a mixture of 751 ml of acetic acid and 751 ml of acetic anhydride were introduced into a 5 l reaction flask provided with a mechanical stirrer, coil type condenser provided with calcium chloride drying tube and thermometer.

The reaction mixture was stirred and heated to reach the temperature of 65° C. and kept between 65° and 75° C. for 4 h. The reaction mixture turned black. Thereupon under reduced pressure by suction pump 563 ml of liquid were distilled off.

To the obtained residue at once 375 ml of toluene were added while stirring. After 5 min 1 l of a saturated aqueous sodium chloride solution was added and stirring was continued for 15 min.

A suspension was formed which was poured into 3.5 l of saturated aqueous sodium chloride solution whereupon the suspension was kept overnight while stirring.

The obtained precipitate was separated by suction filtering and washed 7 times with 940 ml of saturated aqueous sodium chloride solution till reaching a pH of about 4.

The washed precipitate was dried at 50° C. in a ventilated drying stove till constant weight of crude compound (2).

638 g of crude compound (2) was put in a round-bottomed flask and kept refluxing for 20 min in ethyl acetate introduced to reach a volume of 5.1 liter in the flask. The residual solid product was separated by hot filtering and washed 7 times with ethyl acetate up to a total volume of 4.5 l. The washed solid product was dried at 50° C. in ventilated drying stove. The thus treated sodium sulfonate still contained 47.8% by weight of sodium chloride.

Step 2

424.1 g of sodium sulfonate compound (2) as obtained in Step 1 was added portionwise to a mixture of acetonitrile (2.31 l) and N-methyl-pyrrolidinone (77 ml) and heated to a temperature of 34° C. in a reaction flask or 5 l provided with stirrer, downward fitted Liebig's condenser for distillation and receiving flask with calcium chloride drying tube.

The reaction mixture was heated to reflux whereupon 777 ml of acetonitrile were distilled off for azeotropic drying purposes.

Thereupon the Liebig's condenser was replaced by an upwardly fitted coil type condenser provided with calcium chloride drying tube and the content of the reaction flask was cooled to 25° C.

Within a period of 90 min 233.2 ml of $POCl_3$ were added dropwise in the temperature range of 30° to 50° C.

Thereupon the reaction mixture was heated to 60° C. and kept while atirring at that temperature for 2 h.

The reaction mixture was kept overnight at room temperature under nitrogen atmosphere and subsequently poured portionwise into a mixture of ice (1.925 kg) and water (0.986 kg). After 30 min stirring the formed precipitate was separated by suction filtering and washed to neutral with 4 times 308 ml of water.

The obtained crude sulfochloride (3) was dried at 50° C. in a ventilated drying stove. Yield: 67.5%.

The purification proceeded by crystallization from a mixture of toluene and benzine by heating in the presence of active carbon.

Final yield of purified sulfochloride compound (3) 66%.

Step 3

22 g of compound (4) were dissolved in 200 ml of acetone and thereto 36.2 ml of pyridine were added, whereupon in solid state 54.64 g of compound (3) were introduced in the reaction flask. The reaction mixture was heated to reflux temperature and kept boiling with reflux during about 5 h.

Thereupon while stirring vigorously the reaction mixture was poured into a mixture of hydrochloric acid and ice-water. A somewhat sticky product was obtained which after heating and pouring into water precipitated as fine yellow grains. Separation proceeded by suction filtering and after washing with water and drying for 48 h at 45° C. in a ventilated drying stove 62.47 g of compound (5) were obtained.

Step 4

In a reaction flask put on an oil-heateing bath the following ingredients were introduced:

compound (5): 62 g (0.16 ) mole $SnCl_2.2\ H_2O$: 181.2 g (0.8 mole) ethanol: 640 ml (0.25 mole)

The reaction mixture was heated for 1 h at 70° C.

Thereupon at room temperature the reaction mixture was put into a 5 1-reaction flask wherein were also introduced 1088 ml of ethyl acetate.

A saturated aqueous solution of sodium hydrogen carbonate (2000 ml) were added to reach a pH of 8-9 whereby a white gelly product was obtained. To facilitate filtration by suction 680 g of diatomaceous earth were added.

The precipitate was treated with 1 l of ethylacetate.

The aqueous phase was separated and the organic phase extracted twice with 250 ml of saturated aqueous sodium chloride solution.

The organic phase was dried on anhydrous sodium sulfate and after suction filtering concentrated to yield a yellow oily residue.

Said residue was dissolved in ethyl acetate which after evaporation left on drying a sticky yellow product containing 96% by weight of compound (6).

Step 5

54.5 g (0.153 mole) of compound (6) mixed with already hydrolyzed product, i.e. compound (7) were dissolved in 140 ml of methoxypropanol while slightly heating.

To the obtained solution a mixture of 45 ml of water and 21.25 ml of concentrated sulfuric acid were added.

The reaction proceeded exothermally whereupon the reaction mixture was heated at 80° C. for 30 min while stirring efficiently.

The obtained reaction product was poured slowly while still hot into a mixture of ice-water (460 ml) and sodium acetate. $3H_2O$ (145.8 g).

A finely divided beige coloured precipitate was obtained. After suction filtering, washing twice with water (612 ml) the product was dried at 50° C. in a ventilated drying stove. Yield: 40.21 g of crude product (7) containing 80% by weight of pure compound (7).

Step 6

12.5 g of crude product (7) as obtained in step 5 were allowed to react with 23.15 g of compound (8)=compound (XI) prepared as described in U.S. Pat. No. 4,605,613 in a mixture of acetone 303 ml and 23.9 ml of pyridine kept refluxing for 1 h.

Thereupon the reaction mixture was poured into 500 ml of ice-water whereto 65 ml of 5N hydrochloric acid were added.

While stirring a further amount of ice-water was added. An orange precipitate was formed which was separated by suction filtering.

The precipitate was dried at 40° C. in a ventilated drying stove. Yield: of compound (9) 29.3 g (92%).

Step 7

A. 20 g (0.0196 mole) of compound (9) were dissolved in 100 ml of ethylene glycol monomethyl ether acetate and cooled down at 5° C.

B. 4.7 g of compound (10) were suspended in 40 ml of acetic acid and and thereto 3.5 ml of concentrated sulphuric acid together with 3.6 ml of $NO_2.HSO_3$ were added dropwise very slowly to keep the temperature below 20° C. The reaction mixture was stirred for 30 min.

C. while stirring the under B. obtained diazonium salt solution was slowly dropwise added to the solution obtained under A., the temperature being maintained below 5° C. Diazonium salt solution C. was added in sufficient amount to have compound (9) used up completely in the coupling reaction. Stirring was continued for 1 h.

While vigorously stirring the reaction mixture was poured in 0.5 l of ice-water. An orange precipitate was formed which was separated by suction filtering, washed with water and dried under reduced pressure.

Purification of crude compound I proceeded by preparative column chromatrography.

Preparation of compound II of Table 3.

The steps 1 to 6 of the preparation of compound I were repeated and step 7 replaced by step 7' according to the following reaction scheme:

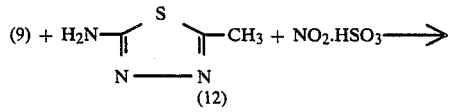

-continued

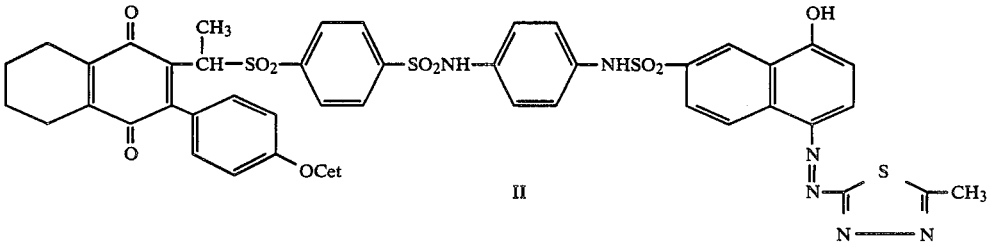

II

A. 9.5 g (9.3 mmole) of compound (9) were dissolved in a mixture of 79 ml of 1,1,1-trichloroethane and 3.4 ml of acetic acid and cooled down to 0° C.

B. 1.7 g (14 mmole) of compound (12) were added to 20.4 ml of acetic acid and stirred till dissolution and to the obtained solution were added dropwise at a temperature below 20° C. 2.31 ml of concentrated sulphuric acid and 2.43 ml of $NO_2.HSO_3$. The reaction mixture was stirred for 30 min. at 15° C.

C. while stirring the under B. obtained diazonium salt solution was slowly dropwise added to the solution obtained under A; the temperature raised from 0° C. to 15° C.

The obtained reaction mixture was poured into ice-water and an orange-red precipitate was formed by adding thereto methanol. Stirring was continued for 30 min. The precipitate was separated by suction filtering, 3 times washed with 100 ml of methanol and dried at 50° C. for 18 h in a ventilated drying stove. Yield: 9.5 g.

Purification of crude compound II proceeded by preparative column chromatography.

Preparation of compound III of Table 3.

Reaction scheme:

Step 1

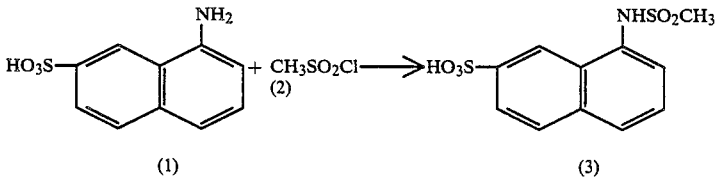

Step 2

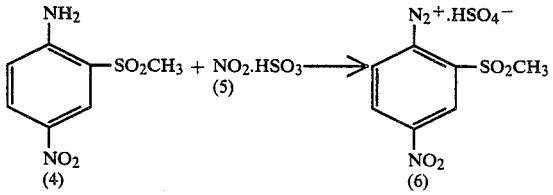

Step 3

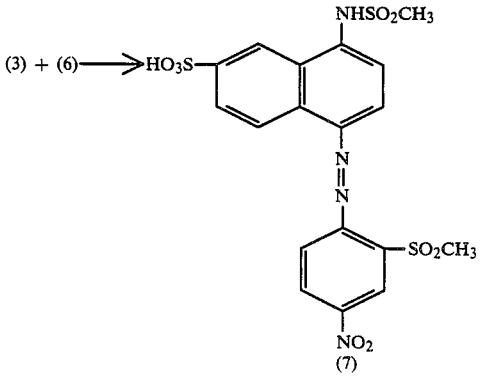

Step 4

-continued

Reaction scheme:

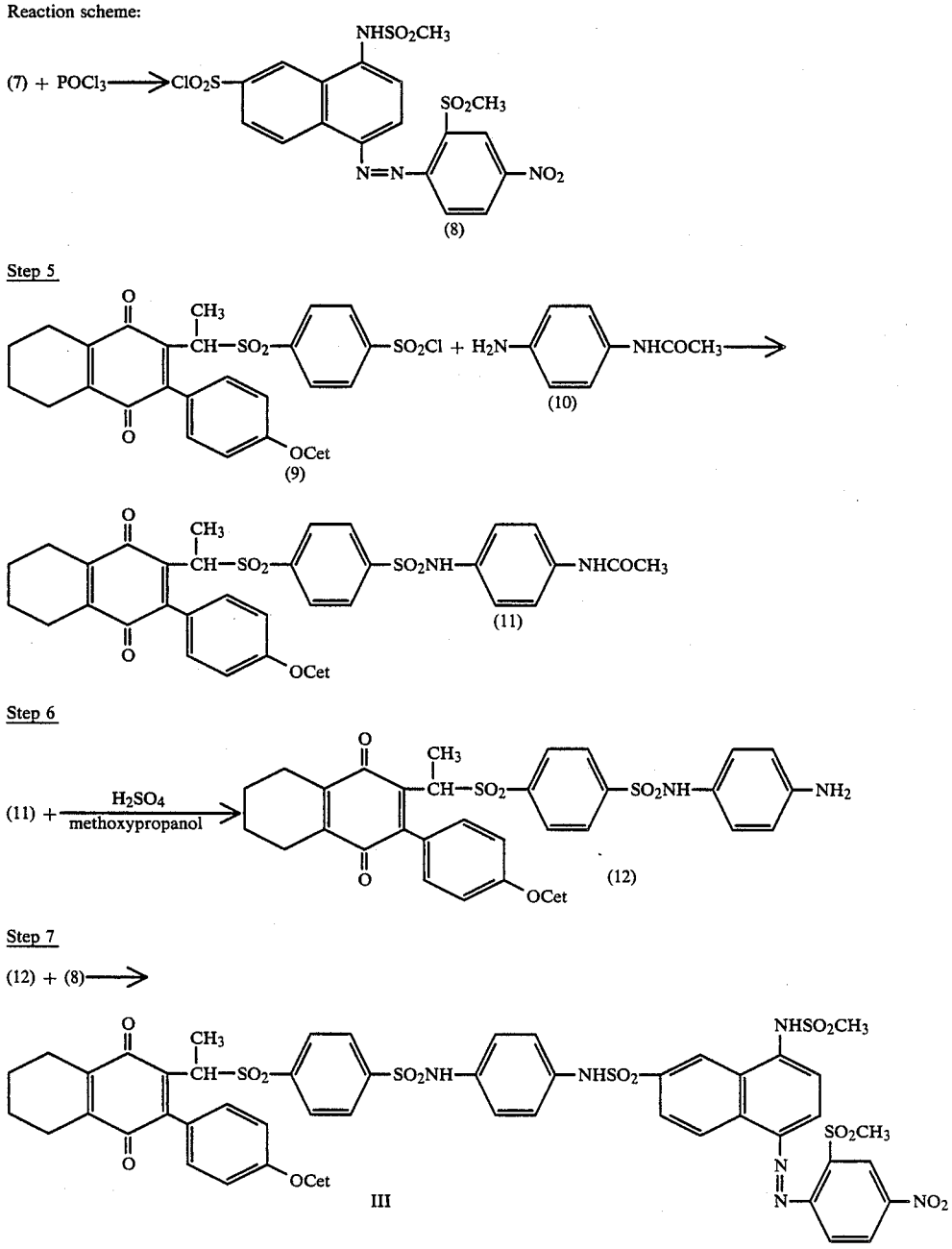

Step 1

167.3 g of compound (1) were dissolved in 450 ml of pyridine. While stirring and cooling 94.7 ml of sulfochloride compound (2) were added dropwise at room temperature. By the exothermic reaction the temperature rose within 1 h to 60° C.

Step 2

In an open flask of 3 l containing 1155 ml of acetic acid 178.3 g of compound (4) were introduced while stirring vigorously. The obtained suspension was kept at 20° C. while a mixture of concentrated sulphuric acid (129.4 ml) and $NO_2HSO_3$ (136 ml) were added in 30 min.

Step 3

To the obtained reaction mixture of step 1 whereto 1875 g of ice was added to diazonium salt solution obtained in step 2 was added dropwise while stirring. After the addition stirring was continued for 4 h and the reaction mixture was kept overnight.

The solids of the obtained slurry were separated by suction filtering, whereupon the filter cake was washed with 3 l of water. The crude product (7) was dried at 50° C. in a ventilated drying stove. Yield: 414.4 g.

Step 4

A suspension of 23.76 g compound (7) in 110 ml of dichloroethane was made whereto while stirring 4.5 ml of N-methylpyrrolidinone and 13.5 ml of phosphorus oxychloride were added dropwise. Hereby the temperature rose to 60° C., whereupon the temperature was raised by heating to 75° C. and kept at that temperature for 4 h. After cooling the reaction mixture was kept overnight and the formed precipitate was separated by suction filtering and washed 2 times with dichloroethane. The precipitate was stirred in 600 ml of ice-water, filtered again and washed with water. After drying at 50° C. for 18 h in a ventilated drying stove 12.47 g of product (8) was obtained.

Step 5

14.15 g of compound (9) were dissolved in 40 ml of acetone and to the obtained solution 2.85 g of compound (10) were added.

The reaction mixture was heated to reflux temperature whereupon 10.8 ml of pyridine were added. The reaction mixture was kept refluxing for 30 min. and thereupon cooled down to 30° C. A white-beige precipitate formed on cooling was separated and discarded.

The filtrate was added to a mixture of 150 ml of water and 11 ml of 12N hydrochloric acid were added while stirring vigorously.

A sticky product with pyridine smell was obtained which after suction filtering was washed thoroughly with water and dried under reduced pressure at 35°-40° C. Yield: 15 g.

Step 6

14.5 g of compound (11) were introduced into a mixture of 69 ml of methoxypropanol, 7.5 ml of water and 7.2 ml of concentrated sulphuric acid. The hydrolysis reaction was carried out at 80° C. for 7 h. Thereupon while stirring the reaction mixture was poured into ice-water (280 ml) containing 36 g of sodium acetate.3-$H_2O$.

The obtained orange precipitate was separated by suction filtering, washed with water and dried at 50° C. for 18 h in a ventilated drying stove. Yield: 13 g.

Step 7

12.5 g of compound (12) and 9.2 g of compound (8) were introduced in a mixture of 135 ml of acetone and 9.3 ml of pyridine. The reaction mixture was heated to reflux and kept refluxing for 1 h. Still hot the reaction mixture was poured into a mixture of ice-water (400 ml) and concentrated hydrochloric acid (12.43 ml). A fine brown precipitate was formed which was separated by suction filtering.

After washing with water the product was dried at 40° C. for 18 h in a ventilated drying stove.

Yield: 18.6 g of compound III.

Preparation of compound XII of Table 3.

Reaction scheme:

Step 1

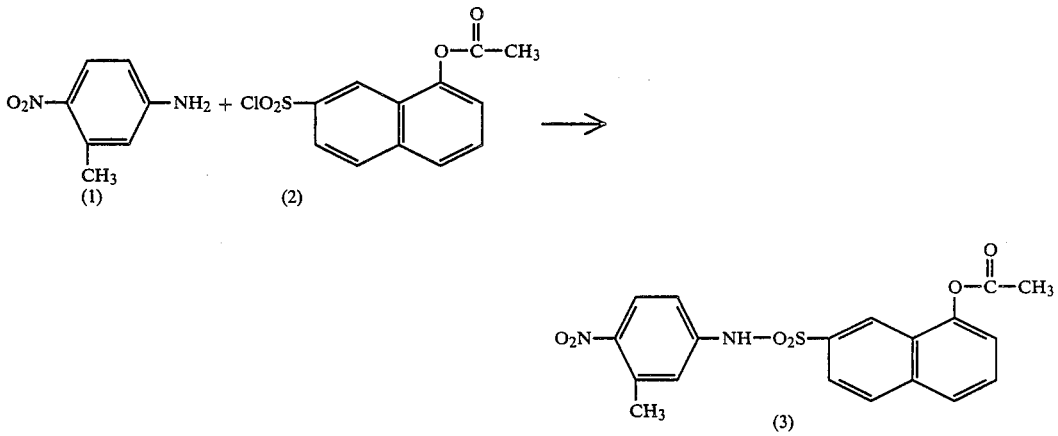

Step 2

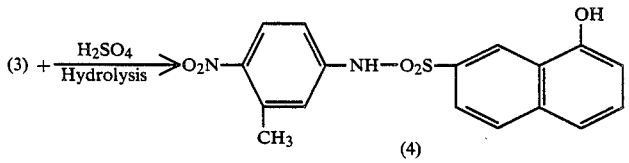

Step 3

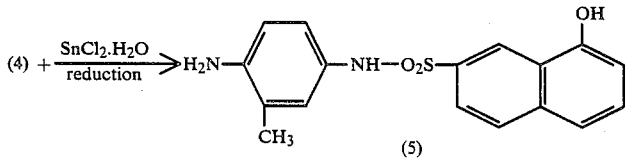

-continued

Reaction scheme:

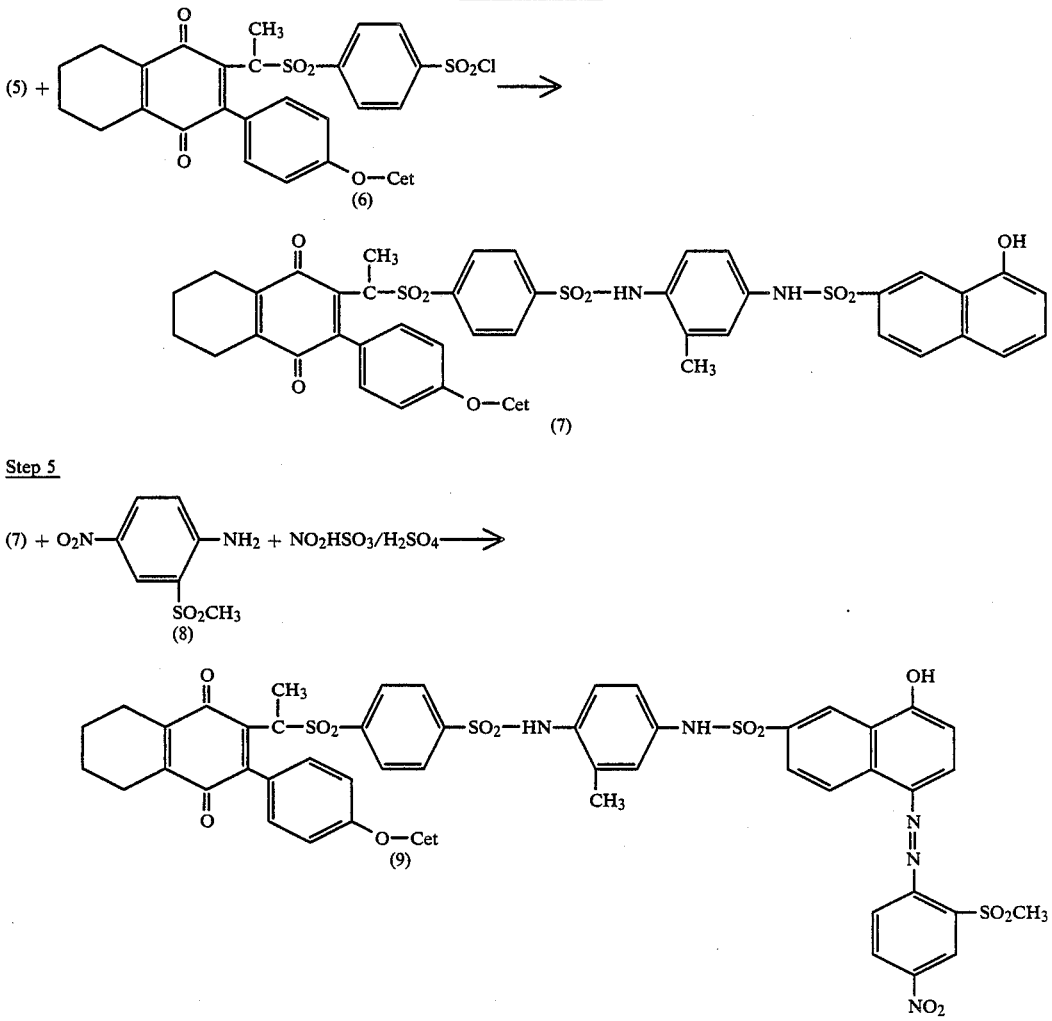

Step 1

22 g (0.145 mole) of compound (1) were dissolved in 160 ml of pyridine and heated to 50° C. To the obtained solution 49.5 g of compound (2) were added portionwise whereupon the temperature was raised to 65° C. Thereupon the temperature was kept at 50° C. for 1 h 20 min. The proceeding of the reaction was followed by thin layer chromatography. At the completion of the reaction the reaction mixture while being still hot was added dropwise to 1.5 l of ice-water acidified with hydrochloric acid (about 214 ml of 12N HCl). The obtained mixture was stirred for 45 min and the obtained precipitate was separated by suction filtering, whereupon it was washed with water and dried for 15 h at 30° C. in an ventilated drying stove.

Step 2

62 g of compound (3) as obtained in step 1 without further purification were suspended at 40° C. in 450 ml of methoxypropanol. To the obtained suspension 54 ml (7 eq.) of sulphuric acid mixed with 50 ml of water were added whereupon the temperature was raised to 80° C. within a period of 30 min. At 80° C. a clear solution was obtained which was added dropwise to ice-water (4 l) wherein were dissolved 133.4 g of sodium acetate.3 $H_2O$. After stirring for 20 min the formed fine precipitate was separated by suction filtering, washed 5 times with 200 ml of water and dried at 30° C. for 15 h in a ventilated drying stove.

Step 3

51 g of crude compound (4) actually containing 48.6 g of pure product was dissolved in 560 ml of ethanol and to the obtained solution 158 g of $Sn\ Cl_2.2\ H_2O$ were added. While stirring the reaction mixture was heated to reach 70° C. within 1 h 30 min.

The reaction mixture was put into 952 ml of ethyl acetate mixed with 1.03 l of a carbonate solution.

After stirring for 30 min 340 g of diatomaceous earth were added as filter aid and after filtration the organic phase was separated and dried overnight on $MgSO_4$. After removing the drying agent and solvent 48 g of crude product (5) were obtained.

Step 4

45 g of crude compound (5), actually containing 43 g of pure product, were dissolved in a mixture of 460 ml of acetone and 46 ml of water. To the obtained solution 87.8 g of compound (6) and 48.8 ml of pyridine were added. The reaction mixture was heated to 65° C. within a period of 1 h 30 min.

The aqueous phase was removed and the organic phase was added slowly to 1.4 of ice-water acidified with 65 ml of 12N HCl.

After stirring for 30 min the obtained precipitate was washed 5 times with 300 ml of water.

The obtained precipitate was dried for 15 h in a ventilated drying stove. Yield: 117 g.

Step 5

A. 50 g of compound (7) were dissolved in 250 ml of ethylene glycol monomethyl ether acetate and the obtained solution was cooled down to 5° C.

B. 11.5 g of compound (8) were suspended in 75 ml of acetic acid and thereto 8.4 ml of concentrated sulphuric acid together and 8.8 ml of $NO_2.HSO_3$ were added dropwise within a period of 15 min.

C. While stirring the under B obtained diazonium salt solution was added slowly and dropwise to the solution obtained under A, the temperature being maintained in the range of 5°-10° C.

The reaction mixture was kept stirring for 20 h and at the end of that period a further amount of 4.2 g of compound (8) were added whereupon stirring was continued for 3 h. The reaction mixture was added dropwise to 1.8 l of ice-water and the obtained precipitate was separated by suction filtering and washed twice with water. After drying the obtained crude compound XII was purified by preparative column chromatography.

Preparation of compound XVII of Table 3.

Reaction scheme:

Step 1

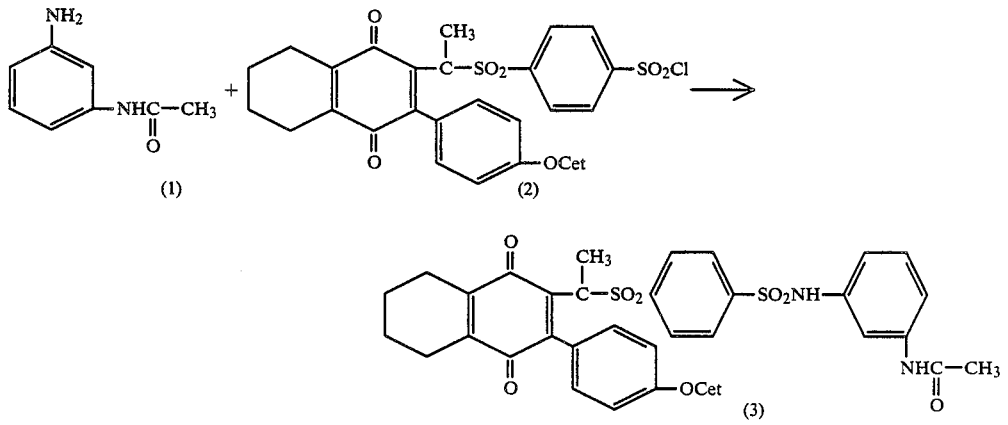

Step 2

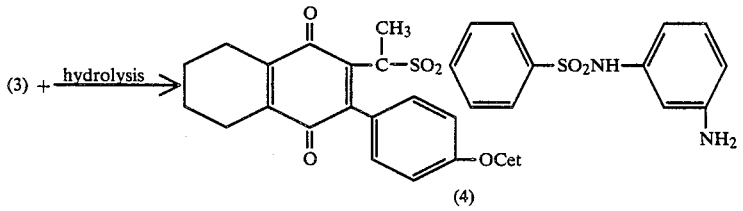

Step 3

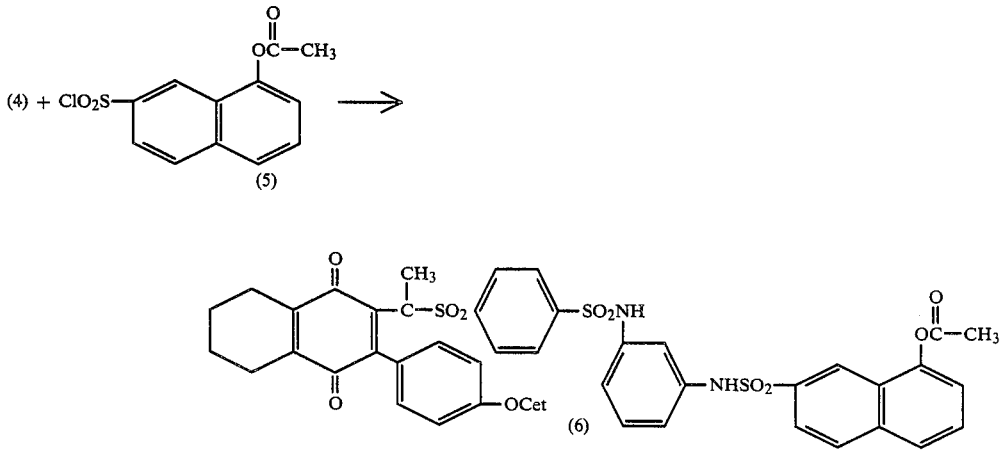

Step 4

-continued

Reaction scheme:

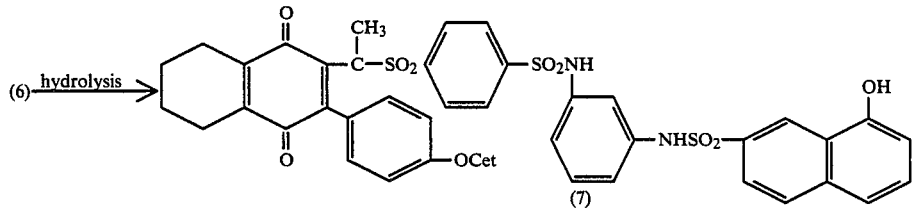

Step 5

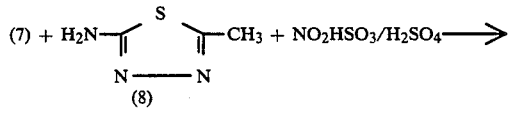

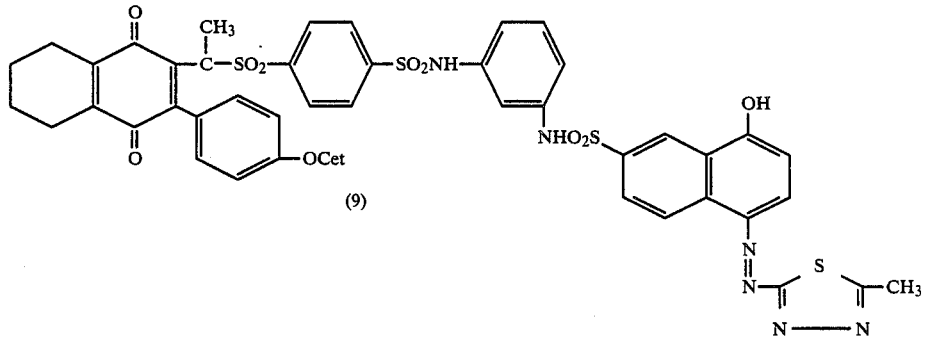

Step 1

14.1 g of compound (1) were dissolved in 154 ml of pyridine and heated to 50° C. To the obtained solution 70 g of compound (2) were added portionwise while stirring. The reaction mixture was kept stirring for 1 h at 50° C. The proceeding of the reaction was followed by thin layer chromatography. At the completion of the reaction the still hot reaction mixture was poured into a mixture of hydrochloric acid and ice. The obtained precipitate was separated by suction filtering and dissolved in methylene chloride. The obtained solution was added again to a mixture of hydrochloric acid and ice and the precipitate obtained on stirring separated by suction filtering, washed till neutral with water and dried. Yield: 78.9 g.

Step 2

78.9 g of compound (3) was dissolved in 789 ml of methoxypropanol. To the obtained solution 234 ml of concentrated hydrochloric acid and 117 ml of water were added. The reaction mixture was boiled with reflux for 2 h 30 min. The obtained reaction mixture while still hot was added with vigorous stirring to a 10% wt solution of sodium hydrogen carbonate in 5 l of crushed ice.

The formed precipitate was separated by suction filtering and washed with water till neutral. The obtained crude compound (4) was dried in a ventilated drying stove. Yield: 63.8 g.

Step 3

62 g of compound (4) were dissolved in 350 ml of pyridine and to the obtained solution 22.7 g of compound (5) dissolved in 102 ml of pyridine were added dropwise at 50° C.

After a reaction period of 1 h the reaction mixture was poured into 600 ml of a mixture of hydrochloric acid and crushed ice. The obtained precipitate was separated by suction filtering, washed till neutral with water and dried at 50° C.

Yield: 71 g of compound (6).

Step 4

70 g of compound (6) was dissolved in 350 ml of methoxypropanol. To the obtained solution 27 ml of water and 27.5 ml of concentrated sulphuric acid were added.

The obtained reaction mixture was boiled with reflux for 1 h 30 min, whereupon it was run as a fine jet into a mixture of ice and water.

The obtained precipitate was separated by suction filtering washed till neutral and dried at 50° C.

Yield: 62 g.

Step 5

A. 30 g of compound (7) was dissolved in 210 ml of ethylene glycol monomethyl ether acetate and the obtained solution was cooled down to 5° C.

B. 5.1 g of compound (8) were suspended in 61.2 ml of acetic acid and thereto 6.9 ml of concentrated sulphuric acid and 7.4 ml of $NO_2.HSO_3$ were added dropwise at 10° to 15° C.

C. while stirring the under B obtained diazonium salt solution was added dropwise to the solution obtained under A, the temperature being maintained at 5° C. The reaction mixture was kept stirring for 4 h and a further amount (0.5 equivalent) of the diazonium salt of reaction B was added. After a further reaction period of 24 h the reaction mixture was poured into a mixture of ice and water. The obtained precipitate was separated by suction filtering, washed till neutral and dried under vacuum to yield crude compound (9) which was purified by preparative column chromatography.

Preparation of compound XVIII of Table 3.

Reaction scheme:
Step 1
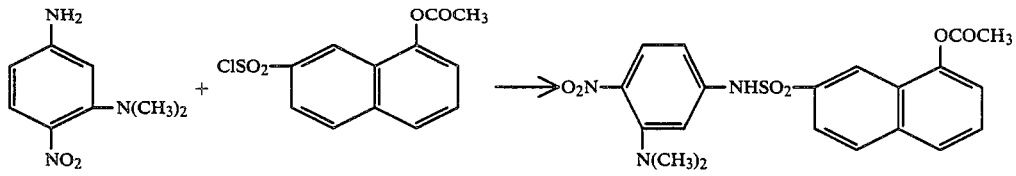
(1) (2) (3)
Step 2
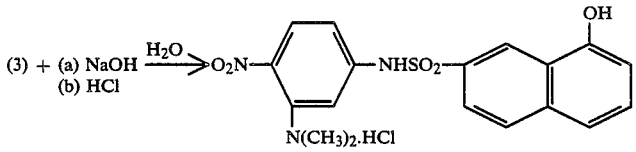
(4)
Step 3
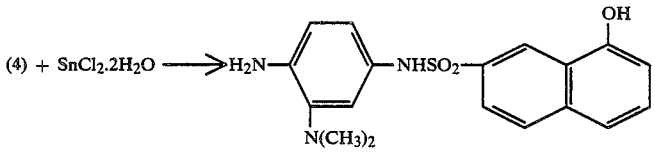
(5)
Step 4
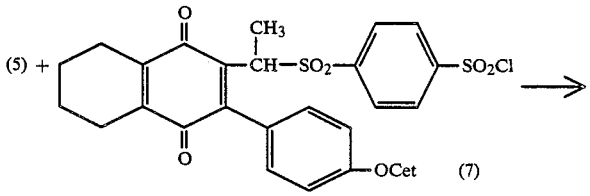
(7)
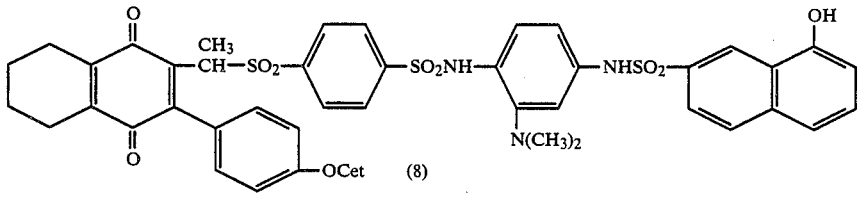
(8)
Step 5
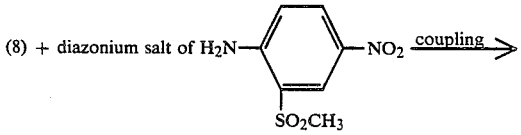
(9)

-continued

Reaction scheme:

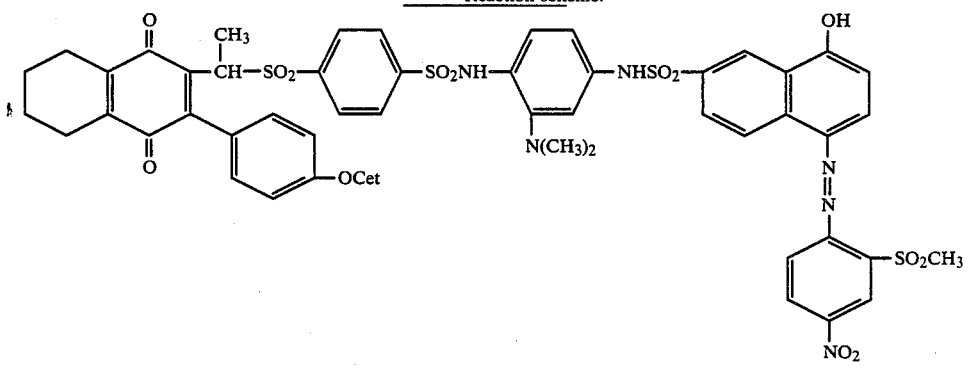

Step 1

15 g of compound (1) were stirred at 20° C. in 100 ml of pyridine. Thereto 24.8 g of compound (2) dissolved in 50 ml of pyridine were added dropwise. At the end of the reaction a further 1.2 g of compound (2) were added and the reaction mixture was kept stirring for 1 h.

The reaction mixture was poured while stirring into 1 l of ice water containing 200 ml of concentrated hydrochloric acid. The formed precipitate [compound (3)] was separated by suction filtering, washed with water till neutral and used in the next reaction step without drying.

Step 2

82.8 mmole of compound (3) were suspended into 300 ml of ethanol with vigorous stirring.

(a) 10 g of sodium hydroxide dissolved in 24 ml of water were added dropwise to the suspension and stirring was continued for 15 min.

(b) the hydrolization mixture was acidified with 1N hydrochloric acid up to pH 2.

The resulting reaction mass was extracted twice with ethyl acetate, a first time with 500 ml and a second time with 250 ml.

The combined extraction liquids were washed with water till neutral and dried over $Na_2SO_4$. The solvent was evaporated and the residue dissolved again by heating in 50 ml of ethyl acetate whereto 10 ml of concentrated hydrochloric acid were added.

After standing overnight the obtained crystalline product [compound (4)] was separated by suction filtering and washed till neutral with ethanol. Yield: 31 g.

Step 3

31 g of compound (4) were dissolved in 300 ml of ethyl acetate and 66.6 g of $SnCl_2.2H_2O$ were added portionwise while stirring. The reaction proceeded exothermically and by cooling the reaction temperature was kept at about 25° C. Stirring was continued for 30 min.

The reaction mixture was poured into 300 ml of ethyl acetate and the pH was adjusted to 8 by adding a buffer solution containing $NaHCO_3$ and $Na_2HPO_4$. Thereupon diatomaceous earth was added as filter aid and the filter cake washed with ethyl acetate. The organic phase was washed with water till neutral and dried on $Na_2SO_4$. After removing ethyl acetate by evaporation 7.4 g of compound (5) were obtained.

In order to increase the yield the wash water was acidified and thereupon the pH brought at 7 with $NaOH/Na_2HPO_4$. The thus treated wash water was extracted with ethyl acetate (twice with 750 ml) and an additional amount (3.5 g) of compound (5) was obtained after evaporation of the dried ethyl acetate.

Step 4

30 g of compound (5) and 59.8 g of compound (7) were dissolved in a mixture of 600 ml of acetone and 29.5 ml of pyridine. The solution was boiled under reflux for 4 h.

After keeping the reaction mixture overnight at 20° C. it was poured while stirring into 2 l of ice-water whereto 50 ml of concentrated hydrochloric acid were added. The formed precipitate was separated by suction filtering, washed till neutral and dried. Yield: 75.1 g of compound (8).

Step 5

(1) diazotization 1.4 g of compound (9) were dissolved in 6.2 ml of acetic acid and cooled to 20° C. While stirring 1.07 ml of sulphuric acid were added and cooling was continued to 15° C., whereupon 1.10 ml of $NOHSO_4$ were added dropwise. Stirring was continued for 30 min at 15° C.

(2) coupling 5.1 g of compound (8) were dissolved in 40 ml of ethylene glycol monomethyl ether acetate and cooled down to 5° C.

The diazonium salt solution obtained under (1) was added dropwise to the cold solution of compound (8) and the reaction mixture was kept stirring at 5° C. for 4 h.

Thereupon the reaction mixture was diluted with 40 ml of water being added dropwise. The formed precipitate was separated by suction filtering washed with water and dried. Yield of compound (10): 4.79 g.

Preparation of compound XIX of Table 3.

IHR-compound XIX was prepared analogously to IHR-compound XVIII using intermediate compound (8) in a coupling reaction with the diazonium salt derived from 2-amino-5-methyl-1,3,4-thiadiazole.

(1) diazotization 1.6 g of 2-amino-5-methyl-1,3,4-thiadiazole were dissolved in 19.2 ml of acetic acid and at 20° C., while stirring, 2.17 ml of sulphuric acid were added dropwise. At 15° C. 2.29 ml of $NOHSO_4$ were added dropwise to the reaction mixture and stirring was continued for 30 min.

(2) coupling 10 g of said intermediate compound (8) were dissolved in a mixture of 85 ml of 1,1,1-trichloro-ethane and 3.8 ml of acetic acid. The obtained solution was cooled down to 0° C. and thereto the diazonium salt solution obtained under (1) was added dropwise while stirring. The reaction mixture was kept stirring for 1 h at 5° C. The reaction mixture was diluted with 100 ml of methanol and poured into 100 ml of water while stirring.

The aqueous phase was decanted and the obtained oily product retreated with water and stirred in 20 ml of acetonitrile till solidification. After separation by suction filtering and washing with fresh acetonitrile compound XIX was dried. Yield: 7.1 g.

Preparation of compound XXI of Table 3.

Reaction scheme:

Step 1

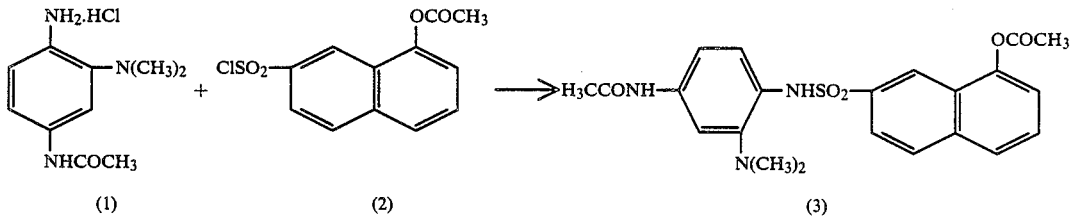

Step 2

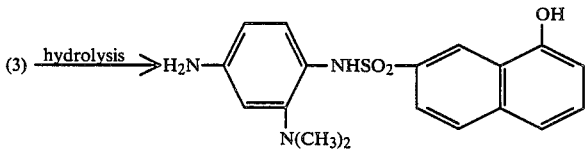

Step 3

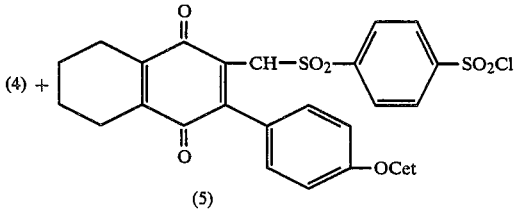

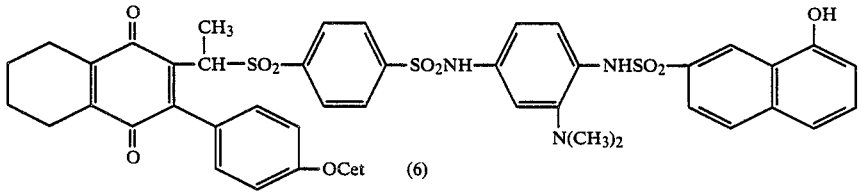

Step 4

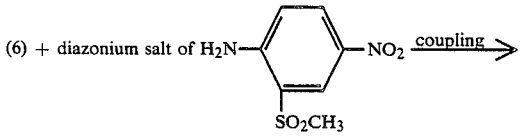

-continued

Reaction scheme:

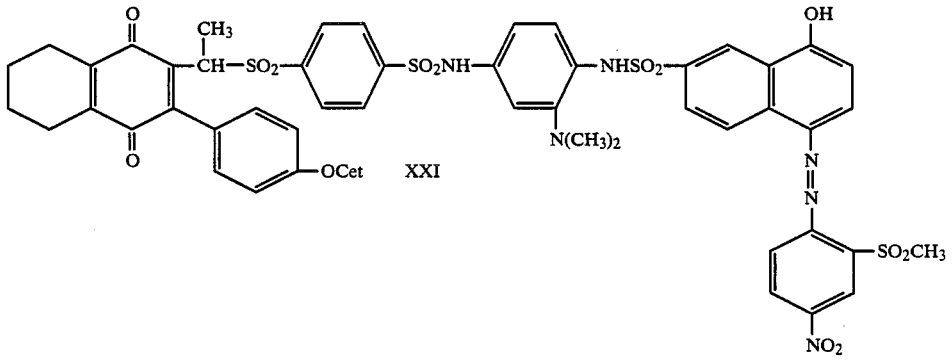

Step 1

20 g of compound (1) were dissolved in 100 ml of pyridine. 26 g of compound (2) dissolved in 50 ml of pyridine were added thereto and the reaction mixture was stirred for 30 min at 20° C. Thereupon the pyridine was evaporated partially. The residue was dissolved in 350 ml of 1N hydrochloric acid. The thus obtained solution was added dropwise to a cold solution of 70 g of $K_2CO_3$ dissolved in 900 ml of ice-water.

The formed precipitate was separated by suction filtering, washed with water till neutral and dried. Yield of compound (3): 36.5 g.

Step 2

32 g of compound (3) were treated with a mixture of 72.5 ml of 4N hydrochloric acid and 72.5 ml of ethanol. The hydrolysis proceeded completely within 3.5 h at reflux temperature.

The reaction mixture was poured into 200 ml of ethyl acetate, washed till neutral and then made alkaline by adding a $K_2CO_3$-solution. The organic phase was dried and the solvent removed by evaporation. Yield of compound (4): 25.3 g.

Step 3

25 g of compound (4) were dissolved in 600 ml of acetone and 28 ml of pyridine. Thereupon 57 g of compound (5) were added and the reaction mixture was kept boiling for 1 h. The cooled down reaction mixture was then poured slowly into 2 l of ice-water whereto 50 ml of concentrated hydrochloric acid were added.

The formed precipitate was separated by suction filtering, washed till neutral and dried.

Yield of compound (6): 78 g.

Step 4

(1) diazotization 2.8 g of compound (7) were dissolved in 11.9 ml of acetic acid and cooled to 20° C. While stirring 2.06 ml of sulphuric acid were added dropwise. Thereupon the temperature was lowered to 15° C. and 2.12 ml of $NOHSO_4$ were added dropwise. Stirring was continued for 30 min.

(2) coupling 10 g of compound (6) were dissolved in 90 ml of ethylene glycol monomethyl ether acetate and cooled down to 0° C.

To the cold solution the diazonium salt solution obtained under (1) was added dropwise and the reaction mixture as kept stirring at 0° C. for 4 h.

The reaction mixture was kept overnight and a further amount (0.5 equivalent) of the diazonium salt was introduced and again kept overnight. Thereupon the reaction mixture was diluted with 150 ml of methanol and subsequently 500 ml of water were added.

The formed precipitate was separated by suction filtering and washed till neutral with water. After extraction with $CH_2Cl_2$ the organic phase was dried over $Na_2SO_4$ and washed with methanol. 10.3 g of crude IHR-compound XXI were obtained. Purification proceeded with column chromatography.

Preparation of compound XXIII of Table 3.

IHR-compound XXIII was prepared analogously to IHR-compound XXI using intermediate compound (6) in a coupling reaction with the diazonium salt derived from 2-amino-5-t.butyl-1,3,4-thiadiazole.

(1) diazotization 2.36 g of 2-amino-5-t.butyl-1,3,4-thiadiazole were dissolved in 19.2 ml of acetic acid and at 20° C. while stirring 2.17 ml of sulphuric acid were added thereto. At 15° C. 2.29 ml of $NOHSO_4$ were added dropwise and stirring was continued for 30 min.

(2) coupling 10 g of said intermediate compound (6) were dissolved in a mixture of 85 ml of 1,1,1-trichloro-ethane and 3.8 ml of acetic acid. The obtained solution was cooled down to 0° C. and the diazonium salt solution obtained under (1) was added dropwise maintaining the reaction mixture while stirring for 1 h at 5° C.

The reaction mixture was diluted with 500 ml of $CH_2Cl_2$, washed with water till neutral and the organic phase was dried on $Na_2SO_4$. After evaporation of the solvent 13.3 g of IHR-compound XXIII were obtained. Purification proceeded by column chromatography.

Preparation of compound XXIV of Table 3.

Reaction scheme:

Step 1

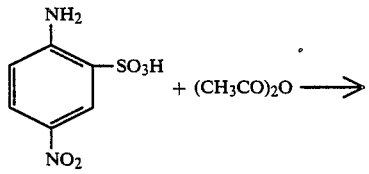

(1)

-continued
Reaction scheme:
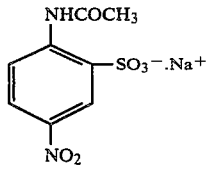
(2)
Step 2
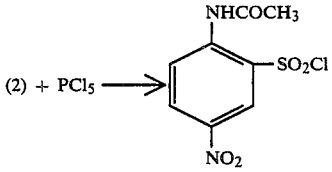
(3)
Step 3
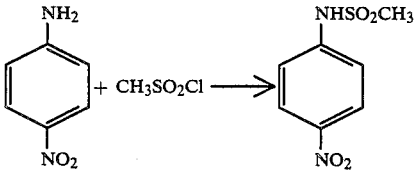
(4) (5)
Step 4
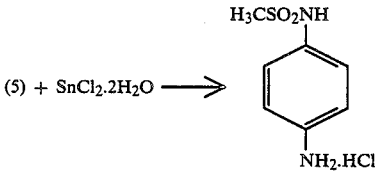
(6)
Step 5
-continued
Reaction scheme:
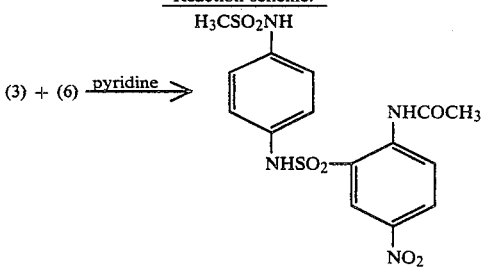
(7)
Step 6
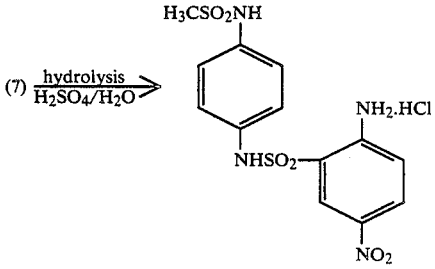
(8)
Step 7
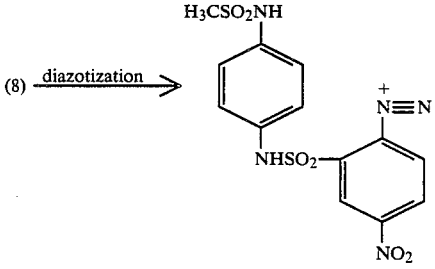
(9)
Step 8
Coupling reaction of the above compound (9) with the compound (9) used in the preparation of IHR-compound I of Table 3 whereby IHR-compound XXIV having the following structural formula is obtained:
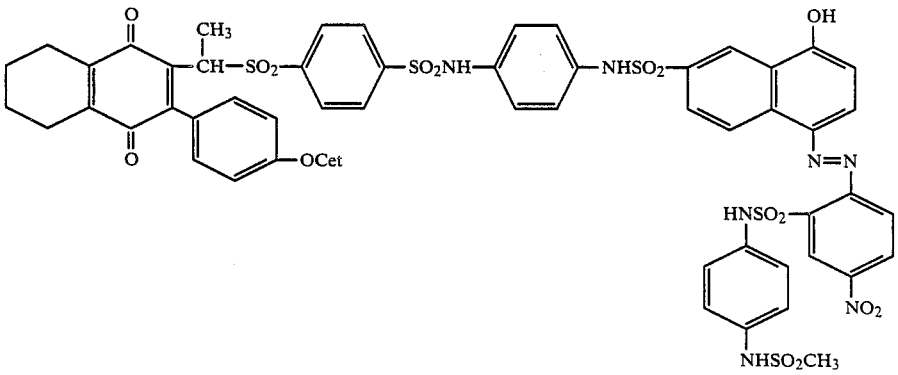

Step 1

750 g of compound (1), 1030 ml of acetic anhydride and 515 g of sodium acetate with introduced into 4.5 l of acetic acid, in a reaction flask provided with a mechanical stirrer.

The reaction mixture was stirred and heated to reflux temperature for 2.5 h.

The reaction mixture was cooled to 50° C., filtered and left overnight.

The formed precipitate was then separated by suction filtering and washed with 1 l of ethyl acetate and the residue was then stirred and poured into 2 l of ethyl acetate for 30 min.

The formed precipitate was then separated by suction filtering and washed twice with 2.5 l of dichloromethane.

After drying 603 g of compound (2) were obtained.

Step 2

While stirring to 15.4 g of $PCl_5$ (solid) 10 g of compound (2) were added portionwise. After 15 min stirring the temperature of the reaction mixture was raised to 70°-80° C. by heating on an oil-bath. While stirring the reaction mixture was maintained at 80° C. for 1 h whereupon it was allowed to cool to room temperature. At room temperature 250 ml of ethyl acetate were added and the obtained diluted reaction mass was poured into 500 ml of ice-water having dissolved therein 70 g of $Na_2HPO_4.12\ H_2O$. The organic phase was then separated and shaked twice with 250 ml of an aqueous saturated sodium chloride solution. The organic phase containing the reaction product was then dried over $Na_2SO_4$. After removing the drying stuff by filtering the organic solvent was evaporated followed by twice the evaporation of 50 ml of n-hexane. 9 g of compound (3) were obtained as a light yellow product.

Step 3

350 ml of compound (4) were dissolved in 3 l of pyridine and while stirring at 20° C. 552 g of $CH_3SO_2Cl$ were added portionwise whereby the temperature was raised to 45° C. The reaction mixture was kept stirring for 4 h at 20° C.

The pyridine was removed almost completely by evaporation and 4 times 250 ml of toluene were added and also evaporated to remove all traces of residual pyridine. Thereupon the residue was stirred in 5 l of saturated aqueous sodium chloride solution for washing purposes and that operation was repeated thrice with each time 1 l of said saturated solution.

The obtained crude product was after drying in a ventilated drying stove crystallized from a mixture of ethanol and methanol, washed twice with 250 ml of cold ethanol and dried.

Yield: 352 g.

Step 4

While stirring 100 g of compound (5), 420 g of $SnCl_2.2H_2O$ and 720 ml of ethyl acetate were introduced into a reaction flask and the temperature raised to 70° C.

Stirring was continued until the ingredients were nearly completely dissolved and a slight turbidity was left.

The reaction mixture was cooled to 60° C. and 720 ml of 12N hydrochloric acid were added while stirring. Cooling was continued to reach 20° C. whereby a crystalline mass separated. The crystals were filtered and to a suspension of the crystals in 1 l of ethyl acetate a saturated sodium carbonate solution was added to reach pH 8. Filter aid was added and the obtained suspension was filtered. The filter cake was washed five times with 250 ml of ethyl acetate. The organic phase was dried over $MgSO_4$, filtered and treated with 40 ml of 12N hydrochloric acid. The crystalline precipitate was washed with ethyl acetate, acetonitrile and acetone. After drying at 40° C. 84.5 g of compound (6) were obtained.

Step 5

17 g of compound (6) were dissolved in 85 ml of pyridine and kept stirring on an ice-bath. To the obtained solution of compound (6) compound (3) was added dropwise in a stoechiometric amount being dissolved in a little $CH_2Cl_2$ while keeping the temperature in the range of 10°-20° C.

The reaction mixture was stirred at 10° C. for 1 h and kept overnight.

Thereupon it was diluted with 925 ml of ethyl acetate and shaked thrice with 500 ml of 1N hydrochloric acid. Then the organic phase was washed thrice with 500 ml of water and twice with a saturated sodium chloride solution. The organic phase was dried on $Na_2SO_4$, filtered and treated with active carbon. Diatomaceous earth was added as filter aid and the filtrate concentrated till dry by evaporation of the solvent. Yield of compound (7): 15.7 g.

Step 6

13.2 g of compound (7) were dissolved in a mixture of 107 ml of 1-methoxy-propanol-2 and 12.3 ml of water. While stirring 10.4 ml of concentrated sulphuric acid were added dropwise. The reaction mixture was kept stirring for 45 min at 80° C. and thereupon cooled down to room temperature. At that temperature it was poured while stirring into 535 ml of 1N hydrochloric acid and stirring was continued for 1 h. After keeping overnight the formed precipitate was separated by suction filtering. The obtained product was dried at 50° C. Yield of compound (8): 12.2 g.

Step 7

Diazotization

With stirring 1.8 g of a compound (8) were introduced into a mixture of 35 ml of acetic acid and 2.59 ml of sulphuric acid at 20° C. While cooling to 15° C. on an ice-bath 2.73 ml of $NO_2HSO_3$ were added dropwise and stirring was continued for 30 min.

Step 8

Coupling

In the temperature range of 0° to 5° C. the diazonium salt solution obtained under (1) was added slowly to a solution of 12.13 g of the compound (9) that has been used in the preparation of IHR-compound I of Table 3, in 125 ml of ethylene glycol monomethyl ether acetate.

The reaction mixture was stirred for 2 h at 0° to 5° C. and kept overnight.

Thereupon an additional amount of diazonium salt corresponding with 2 g of amine were added at 0° to 5° C. and the reaction mixture kept again overnight.

Finally the reaction mixture was poured while stirring into 750 ml of water and stirring was continued for 5 min. The formed precipitate was separated by suction filtering, washed three times with 100 ml of water and dried at 50° C. Yield of IHR-compound XXIV: 17.3 g.

Analogously to the preparation of said IHR-compound XXIV, the following IHR-compound XXXII, XXXIII and XXXIV were prepared by using intermediate products containing another bivalent organic group G as described e.g. in U.S. Pat. No. 4,605,613.

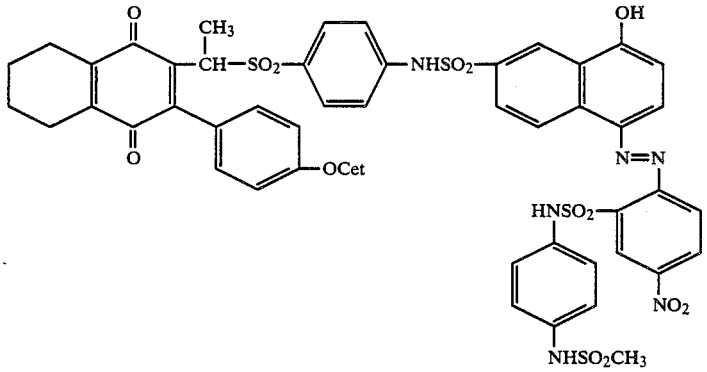

XXXII

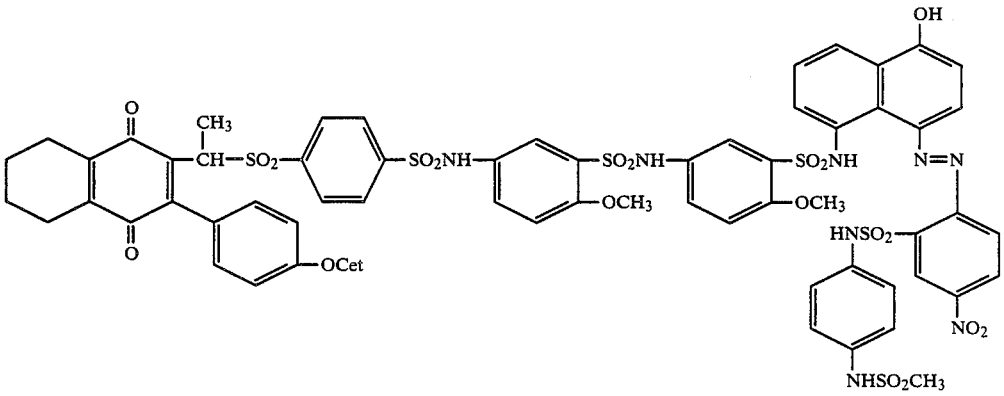

XXXIII

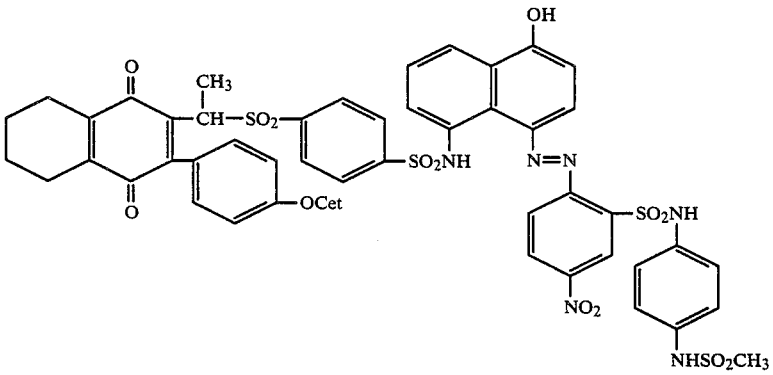

XXXIV

The synthesis of the other compounds of Table 3 proceeds analogously to the preparations given in detail above by using the proper dye part intermediates.

The compounds according to the present invention are suited for use in a dye diffusion transfer process and for that purpose are used in operative association with a light-sensitive silver halide emulsion layer, preferably of the negative-working type, i.e. of the type obtaining a silver image in the photo-exposed areas.

For dye image production a photographic silver halide emulsion material according to the present invention comprises a support carrying at least one alkali-permeable silver halide hydrophilic colloid emulsion layer having in operative association therewith a said dye releasing compound according to the present invention.

By "operative association" is understood that the release of a diffusible dye moiety, e.g. azo dye, from the compound can proceed in function of the development of the silver halide emulsion layer. Therefore, the dye-releasing compound has not necessarily to be present in the silver halide emulsion layer but may be contained in another layer being in water-permeable relationship therewith.

In an embodiment for producing multicolour images this invention relates to a photographic material that comprises a support carrying (1) a red-sensitive silver halide emulsion layer having operatively associated therewith a dye-releasing compound that is initially immobile in an alkali-permeable colloid medium and wherefrom in function of the reducing action of a silver halide developing agent and alkalinity a cyan dye is split off in diffusible state, (2) a green-sensitive silver halide emulsion layer having operatively associated therewith another dye releasing compound with the difference that a magenta dye is split off in diffusible state, and (3) a blue-sensitive silver halide emulsion layer having operatively associated therewith still another dye releasing compound with the difference that a yellow dye is split off in diffusible state, at least one of said dye releasing compounds being one of the compounds according to the present invention as defined above.

In the present colour-providing compounds the dye groups(s) may be associated with substituents that form a shifted dye.

Shifted dyes as mentioned, e.g., in U.S. Pat. No. 3,260,597 include those compounds wherein the light-absorption characteristics are shifted hypsochromically or bathochromically when subjected to a different environment such as a change of the $pK_a$ of the compound.

It has been established that the incorporation of the compounds corresponding to the general formula of Research Disclosure 24236 of June 1984, pages 275 to 278, in a silver halide emulsion layer of the negative type for use according to colour diffusion transfer reversal processes, may lead to a favourable fog-inhibition without retarding of the development. Examples of such compounds are 1-[meta(2-sulphobenzamido)-phenyl]-5-mercaptotetrazole, 1-(meta-carboxymethylthioacetamido)-phenyl-5-mercaptotetrazole and the sodium salt of 3-methyl-4-orthosulphobenzamido-5-thio-1H-1,2,4-triazole.

It is preferred to carry out the colour diffusion transfer process with the present coloured IHR-quinonoid compounds in conjunction with a mixture of reducing agents at least two of which being a compound called electron donor (ED-compound) and a compound called electron-transfer agent (ETA-compound) respectively.

The ED-compounds are preferably non-diffusing, e.g. are provided with a ballasting group, so that they remain within the layer unit wherein they have to transfer their electrons to the quinonoid compound.

The ED-compound is preferably present in non-diffusible state in each silver halide emulsion layer containing a different non-diffusible coloured IHR-quinonoid compound. Examples of such ED-compounds are ascorbyl palmitate and 2,5-bis(1', 1', 3', 3'-tetramethylbutyl)-hydroquinone. Other ED-compounds are disclosed in U.S. Pat. No. 4,139,379 and in published DE-A No. 2,947,425. Instead of an ED-compound an electron-donor precursor (EDP) compound can be used in the photographic material as described e.g. in published DE-A No. 2,809,716 and in U.S. Pat. No. 4,278,750. Particularly useful ED-precursor compounds for combination with the present IHR compounds are disclosed in published EP-A No. 0 124 915 and in published DE-A No. 3,006,268, wherein the compound corresponds to the following general formula:

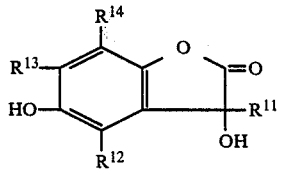

wherein:

$R^{11}$ represents a carbocyclic or heterocyclic aromatic ring, each of $R^{12}$, $R^{13}$ and $R^{14}$ (same or different) represents hydrogen, alkyl, alkenyl, aryl, alkoxy, alkylthio, amino, or $R^{13}$ and $R^{14}$ together represent an adjacent ring, e.g. carbocyclic ring, at least one of $R^{11}$, $R^{12}$, $R^{13}$ and $R^{14}$ representing a ballast group having from 10 to 22 carbon atoms.

The ETA-compound is preferably used as developing agent in diffusible state and is, e.g., incorporated in mobile form in (a) hydrophilic colloid layer(s) adjacent to one or more silver halide emulsion layers or applied from the processing liquid for the dye diffusion transfer.

Typically useful ETA-compounds include hydroquinone compounds, aminophenol compounds, catechol compounds, phenylenediamines and 3-pyrazolidinone compounds e.g. 1-aryl-3-pyrazolidinone as defined, e.g., in U.S. Pat. No. 4,139,379.

A combination of different ETA's such as those disclosed in U.S. Pat. No. 3,039,869 can be employed likewise. Such developing agents can be used in the liquid processsing composition or may be contained, at least in part, in any layer or layers of the photographic element or film unit such as the silver halide emulsion layers, the dye image-providing material layers, interlayers, image-receiving layer, etc. The particular ETA selected will, of course, depend on the particular electron donor and quinonoid compound used in the process and the processing conditions for the particular photographic element.

The concentration of ED-compound or ED-precursor compound in the photographic material may vary within a broad range but is, e.g., in the molar range of 1:1 to 8:1 with respect to the quinonoid compound. The ETA-compound may be present in the alkaline aqueous liquid used in the development step, but is used preferably in diffusible form in a non-sensitive hydrophilic colloid layer adjacent to at least one silver halide emulsion layer.

Migration of non-oxidized developing agent, e.g. acting as ETA-compound, proceeds non-image-wise and has an adverse effect on correct colour rendering when surplus developing agent remains unoxidized in the photoexposed areas of a negative-working emulsion layer. Therefore, according to a preferred embodiment of the present invention a silver halide solvent, e.g. thiosulphate, is used to mobilize unexposed silver halide in complexed form for helping to neutralize (i.e. oxidize by physical development) migrated developing agent in the photoexposed areas wherein unaffected developing agent (ETA-compound) should no longer be available for reacting with the quinonoid compound directly or through the applied ED-compound. The use of silver halide solvents for that purpose has been described in the published EP-A No. 0049002.

In order to obtain a better colour rendition it is also advantageous to intercept oxidized ETA-compound and to prevent it from migrating to adjacent imaging layers where it could cause the undesired oxidation of ED-compound. For said interception so-called scavengers are used that are incorporated in the photographic material in non-diffusible state, e.g. in interlayers between the imaging layers. Suitable scavengers for that purpose are described, e.g., in U.S. Pat. No. 4,205,987 and EP-A No. 0,029,546.

The present dye releasing compounds and optionally ED or EDP-compounds can be incorporated in the photographic material by addition to the coating liquid(s) of its layer(s) by the usual methods known, e.g., for the incorporation of colour couplers in photographic silver halide emulsion materials.

The amount of dye-releasing compound coated per sq.m may vary within wide limits and depends on the maximum colour density desired.

The photographic material may contain (a) filter layer(s) to improve the correct spectral exposure of the differently spectrally sensitive silver halide emulsion layers, e.g. a yellow (colloidal silver) layer below the only blue-sensitive silver halide emulsion layer and a magenta filter layer below the green-sensitive silver halide emulsion layer absorbing green light whereto the underlying red-sensitized silver halide emulsion layer may be sensitive to some extent. A suitable magenta dye for that purpose is Violet Quindo RV 6911 - Colour Index, C.I 46500 Pigment Violet 19.

The support for the photographic elements of this invention may be any material as long as it does not deleteriously affect the photographic properties of the film unit and is dimensionally stable. Typical flexible sheet materials are paper supports, e.g. coated at one or both sides with an Alpha-olefin polymer, e.g. polyethylene; they include cellulose nitrate film, cellulose acetate film, poly(vinyl acetal) film, polystyrene film, poly(ethylene terephthalate) film, polycarbonate film, poly-Alpha-olefins such as polyethylene and polypropylene film, and related films or resinous materials. The support is usually about 0.05 to 0.15 mm thick.

The image-receiving layer can form part of a separate image-receiving material or form an integral combination with the light-sensitive layer(s) of the photographic material.

Where the image-receiving layer after processing of the photosensitive material remains associated with the silver halide emulsion layer(s) normally an alkali-permeable light-shielding layer, e.g. containing white pigment particles is applied between the image-receiving layer and the silver halide emulsion layer(s).

For use in dye diffusion transfer photography any material may be employed as the image-receiving layer as long as the desired function of mordanting or otherwise fixing the diffused dye will be obtained. The particular material chosen will, of course, depend upon the dye to be mordanted. If acid dyes are to be mordanted, the image-receiving layer may be composed of or contain basic polymeric mordants such as polymers of amino-guanidine derivatives of vinyl methyl ketone such as described in U.S. Pat. No. 2,882,156 of Louis M. Minsk, issued Apr. 14, 1959, and basic polymeric mordants and derivatives, e.g. poly-4-vinylpyridine, the metho-p-toluene sulphonate of 2-vinylpyridine and similar compounds described in U.S. Pat. No. 2,484,430 of Robert H. Sprague and Leslie G. Brooker, issued Oct. 11, 1949, and the compounds described in the published DE-A No. 2,200,063 filed Jan. 11, 1971 by Agfa-Gevaert A. G. Suitable mordanting binders include, e.g., guanylhydrazone derivatives of acyl styrene polymers, as described, e.g., in published DE-A No. 2,009,498 filed Feb. 28, 1970 by Agfa-Gevaert A. G. In general, however, other binders, e.g. gelatin, would be added to the last-mentioned mordanting binders. Effective mordanting compositions are long-chain quaternary ammonium or phosphonium compounds or ternary sulphonium compounds, e.g. those described in U.S. Pat. Nos. 3,271,147 of Walter M. Bush and 3,271,148 of Keith E. Whitmore, both issued Sept. 6, 1966, and cetyltrimethyl-ammonium bromide. Certain metal salts and their hydroxides that form sparingly soluble compounds with the acid dyes may be used too. The dye mordants are dispersed in one of the usual hydrophilic binders in the image-receiving layer, e.g. in gelatin, polyvinylpyrrolidone or partly or completely hydrolysed cellulose esters.

Generally, good results are obtained when the image-receiving layer, which is preferably permeable to alkaline solution, is transparent and about 4 to about 10 μm thick. This thickness, of course, can be modified depending upon the result desired. The image-receiving layer may also contain ultraviolet-absorbing materials to protect the mordanted dye images from fading, brightening agents such as the stilbenes, coumarins, triazines, oxazoles, dye stabilizers such as the chromanols, alkyl-phenols, etc.

Use of pH-lowering material in the dye-image-receiving element will usually increase the stability of the transferred image. Generally, the pH-lowering material will effect a reduction of the pH of the image layer from about 13 or 14 to at least 11 and preferably 5 to 7 within a short time after imbibition. E.g., polymeric acids as disclosed in U.S. Pat. No. 3,362,819 of Edwin H. Land, issued Jan. 9, 1968, or solid acids or metal salts, e.g. zinc acetate, zinc sulphate, magnesium acetate, etc., as disclosed in U.S. Pat. No. 2,584,030 of Edwin H. Land, issued Jan. 29, 1952, may be employed with good results. Such pH-lowering materials reduce the pH of the film unit after development to terminate development and substantially reduce further dye transfer and thus stabilize the dye image.

An inert timing or spacer layer may be employed over the pH-lowering layer, which "times" or controls the pH reduction depending on the rate at which alkali diffuses through the inert spacer layer. Examples of such timing layers include gelatin, polyvinyl alocohol or any of the colloids disclosed in U.S. Pat. No. 3,455,686 of Leonard C. Farney, Howard G. Rogers and Richard W. Young, issued July 15, 1969. The timing layer may be effective in evening out the various reaction rates over a wide range of temperatures, e.g., premature pH reduction is prevented when imbibition is effected at temperatures above room temperature, e.g. at 35° to 37° C. The timing layer is usually about 2.5 μm to about 18 μm thick. Especially good results are obtained if the timing layer comprises a hydrolysable polymer or a mixture of such polymers that are slowly hydrolysed by the processing composition. Examples of such hydrolysable polymers include polyvinyl acetate, polyamides, cellulose esters, etc.

An alkaline processing composition employed in the production of dye images according to the present invention may be a conventional aqueous solution of an alkaline material, e.g. sodium hydroxide, sodium carbonate or an amine such as diethylamine, preferably possessing a pH beyond 11.

According to one embodiment the alkaline processing liquid contains the diffusible developing agent that effects the reduction of the silver halide, e.g. ascorbic acid or a 3-pyrazolidinone developing agent such as 1-phenyl-4-methyl-3-pyrazolidinone.

The alkaline processing composition employed in this invention may also contain a desensitizing agent such as methylene blue, nitro-substituted heterocyclic compounds, 4,4'-bipyridinium salts, etc., to insure that the photosensitive element is not further exposed after its removal from the camera for processing.

For in-camera-processing, the solution also preferably contains a viscosity-increasing compound such as a high-molecular-weight polymer, e.g. a water-soluble ether inert to alkaline solutions such as hydroxyethylcellulose or alkali metal salts of carboxymethylcellulose such as sodium carboxymethylcellulose. A concentration of viscosity-increasing compound of about 1 to about 5% by weight of the processing composition is preferred. It imparts thereto a viscosity of about 100 mPa.s to about 200,000 mPa.s.

Although the common purpose in the known dye-diffusion transfer systems is the production of dye images in a receiving layer or sheet whereby the released dye(s) are eliminated from the photosensitive element by diffusion transfer, a residual image of dye may be likewise of practical interest forming a so-called "retained image". The latter terminology is used, e.g., in Research Disclosure (No. 17362) of September 1978 and a dye-diffusion process relating thereto is exemplified in Research Disclosure (No. 22711) of March 1983.

Processing may proceed in a tray developing unit as is contained, e.g., in an ordinary silver complex diffusion transfer (DTR) apparatus in which contacting with a separate dye image-receiving material is effected after a sufficient absorption of processing liquid by the photographic material has taken place. A suitable apparatus for said purpose is the COPYPROOF CP 38 (trade name) DTR-developing apparatus. COPYPROOF is a trade name of Agfa-Gevaert, Antwerp/Leverkusen.

According to an embodiment wherein the image-receiving layer is integral with the photosensitive layer(s), the processing liquid is applied from a rupturable container or by spraying.

A rupturable container that may be employed is e.g. of the type disclosed in U.S. Pat. No. 2,543,181 of Edwin H. Land, issued Feb. 27, 1951, U.S. Pat. No. 2,643,886 of Ulrich L. di Ghilini, issued June 30, 1953, U.S. Pat. No. 2,653,732 of Edwin H. Land, issued Sept. 29, 1953, U.S. Pat. No. 2,723,051 of William J. McCune Jr., issued Nov. 8, 1955, U.S. Pat Nos. 3,056,492 and 3,056,491, both of John E. Campbell, issued Oct. 2, 1962, and U.S. Pat. No. 3,152,515 of Edwin H. Land, issued Oct. 13, 1964. In general, such containers comprise a rectangular sheet of fluid- and air-impervious material folded longitudinally upon itself to form two walls that are sealed to one another along their longitudinal and end margins to form a cavity in which processing solution is contained.

In the above described dye diffusion transfer processing the development temperature is normally room temperature, i.e. about 20° C., but according to a particular embodiment the dye releasing compounds according to the present invention are used in a so-called photothermographic dye diffusion transfer method, e.g. of the type described in published European Patent Application No. 0 120 306 and in DE-A-32 15 485.

In said embodiment the image formation comprises the image-wise exposing of a light-sensitive material and its heating in the presence of a small amount of water, the material comprising a support having provided thereon light-sensitive silver halide in a binder, a reducing agent capable of reducing the light-sensitive silver halide, and at least one of the dye releasing compounds according to the present invention.

In an embodiment of said method a photographic material is used which contains a combination of silver halide silverbenzotraizolate, a developing agent and a said dye releasing compound and a base precursor releasing a base on heating as described e.g. in GB-P 998.949. The image-wise exposed photographic material being wetted with water as sole processing liquid is during contact with an image-receiving element subjected to heat, whereby development of the exposed silver halide and transfer of image-wise released dye takes place.

According to a particular embodiment the heat-induced development of the exposed silver halide proceeds in the presence of a thermal solvent.

Examples of thermal solvents and their use are given in Research Disclosure publications, October 1976, item 15 027, November 1976, item 15 108 and June 1978 item 17 029, in DE-OS Nos. 3 529 930 and 3 529 934 and in published EP-A Nos. 119 615 and 112 512.

Thermal solvents are solid at room temperature (20° C.) but play the role of a good solvent for water-soluble compounds in molten form by their relatively strong dipole moment.

The following examples further illustrates the present invention.

All percentages and ratios are by weight, unless otherwise mentioned, and the amounts are expressed per sq.m.

EXAMPLE 1 (comparative example)

Preparation of photographic material

A subbed polyethylene terephthalate support having a thickness of 0.1 mm was coated in the mentioned order with the following layers:

(1) a silver halide emulsion layer containing:
gelatin: 2.0 g
AgCl expressed as $AgNO_3$: 0.6 g
IHR-compound of Table 3: 0.32 mmole/sq.m.
ED compound: 2,5-bis(1',1',3',3'-tetramethylbutyl)-hydroquinone: 0.25 g (2) protective layer containing:
gelatin: 2.5 g
1-phenyl-4-methyl-pyrazolidin-3-one: 0.25 g
citric acid to lower the pH: 0.06 g Other dye releasing compounds indicated in Table X were coated in the same way using the same molar amount.

The processing was carried out in a COPYPROOF (registered trade name of Agfa-Gevaert N.V. Belgium) CP 38 diffusion transfer processing apparatus having in its tray an aqueous solution containing per liter:
sodium hydroxide: 25 g
sodium orthophosphate: 25 g
cyclohexane dimethanol: 80 g
potassium iodide: 2 g
sodium thiosulphate: 2 g
2,2-methylpropylpropane diole: 25 g
N-ethylbenzene-pyridinium chloride: 0.5 g
distilled water to make: 1000 ml After being wetted at room temperature (20° C.) with said solution the exposed photographic materials were contacted for 1 min with the receptor material as described hereinafter to allow the diffusion transfer of the dyes. After separating the photographic materials from the receptor material the visual light spectral density obtained by the dye transfer was measured with a MACBETH (trade name) densitometer RD-919 in the Status A modus.

The stability against light was tested with a XENOTEST (trade name) type 50 apparatus of Hanau Quartzlampen GmbH, Hanau, W. Germany wherein the material was exposed with white light for 8 h. The % loss in maximum density of transferred dye is mentioned in Table 4.

Preparation of the dye receptor material

To a corona-treated polyethylene coated support a coating having the following composition was applied per sq.m.:

| | |
|---|---|
| (1) gelatin | 2.5 g |
| polymeric mordanting agent prepared from 4,4'-diphenylmethane diisocyanate and N—ethyldiethanolamine quaternized with epichlorohydrine according to Example 1 of US-P 4,186,014 | 2.5 g |
| (2) protective gelatin layer | 0.8 g |

TABLE 4

| | % loss in maximum density |
|---|---|
| Compound of Table 3 | |
| I | −12 |
| II | −12 |
| III | −5 |
| Comparison compound of Table 5 | |
| Z | −40 |
| P | −45 |
| Q | −29 |

TABLE 5

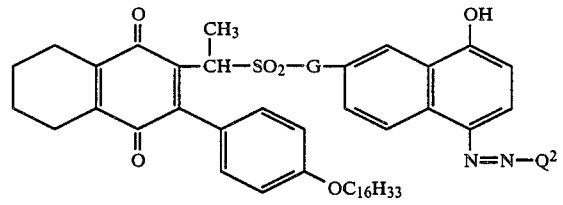

| Comparison compound | G | $Q^2$ |
|---|---|---|
| Z | 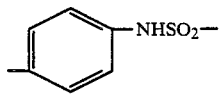 | 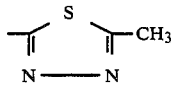 |
| P | 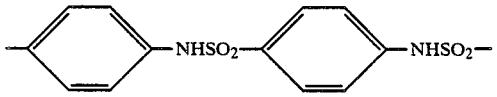 | 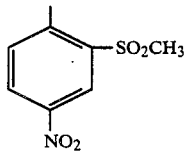 |
| Q | 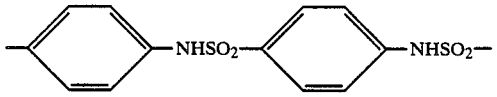 | 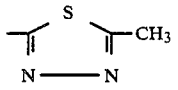 |

The preparation of the comparison compounds proceeds according to techniques of synthesis analogously to them described in published EP-A No. 0 219 892 and published EP-A No. 0 177 982.

EXAMPLE 2 (comparative example)

Preparation of photographic material

A subbed polyethylene terephthalate support having a thickness of 0.1 mm was coated in the mentioned order with the following layers:

(1) a silver halide emulsion layer containing:
gelatin: 1.7 g
AgCl expressed as $AgNO_3$: 0.6 g
IHR-compound of the type and coverage as defined in Table 6
ED compound as defined and at the coverage given in Table 6
(2) protective layer containing:
gelatin: 2.5 g
1-phenyl-4-methyl-pyrazolidin-3-one: 0.25 g
citric acid to lower the pH: 0.06 g The processing was carried out in a COPYPROOF (registered trade name of Agfa-Gevaert N.V. Belgium) CP 38 diffusion transfer processing apparatus having in its tray an aqueous solution containing per liter:
sodium hydroxide: 25 g
sodium orthophosphate: 25 g
cyclohexane dimethanol: 80 g
sodium bromide: 2 g
sodium thiosulphate: 2 g
distilled water to make: 1000 ml After being wetted at room temperature (20° C.) with said solution the exposed photographic materials were contacted for 1 min with the receptor material as described hereinafter to allow the diffusion transfer of the dyes. After separating the photographic materials from the receptor material the visual light spectral density obtained by the dye transfer was measured with a MACBETH (trade name) densitometer RD-919 in the Status A modus.

Preparation of the dye receptor material

To a corona-treated polyethylene coated support a coating having the following composition was applied per sq.m:

| | |
|---|---|
| (1) gelatin | 2.5 g |
| polymeric mordanting agent prepared from 4,4'-diphenylmethane diisocyanate and N—ethyldiethanolamine quaternized with epichlorohydrine according to Example 1 of US-P 4,186,014 | 2.5 g |
| (2) protective gelatin layer | 0.8 g |

The stability against light was tested with a XENOTEST (trade name) type 50 apparatus of Hanau Quartzlampen GmbH, Hanau, W. Germany wherein the material was exposed with white light for 8 h. The % loss in maximum density ($D_{max}$) of transferred dye is mentioned in Table 6.

The applied ED-compound had the following structure:

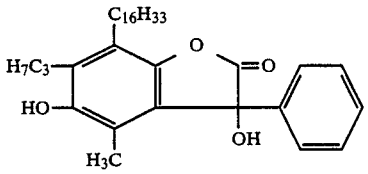

TABLE 6

| IHR-compound-g/m2 | ED-compound-g/m2 | % loss in $D_{max}$ |
|---|---|---|
| XXIV −0.35 | 0.13 | −7 |
| XXXII −0.31 | 0.13 | −13 |
| XXXIII −0.40 | 0.13 | −13 |
| XXXIV −0.31 | 0.13 | −23 |
| **Comparison compound-g/m2 (see Table 7)** | **ED-compound-g/m2** | **% loss in $D_{max}$** |
| L-0.36 | 0.13 | −28 |
| M-0.36 | 0.13 | −30 |

wherein:

CAR represents a hydroquinone type or quinone type moiety capable of undergoing a redox-reaction, L represents a chemical group cleavable or releasable from the carrier moiety by a redox-reaction which takes place under alkaline conditions, G represents a bivalent organic linking group, and D is an azo dye part directly chemically linked to G, characterised in that said compound comprises in its structure a group —$Ar^1$—$SO_2NR$—$Ar^2$—$NRSO_2$— so that:

(1) the group —$Ar^1$—$SO_2NR$—$Ar^2$—$NRSO_2$— is the bivalent organic linking group G, wherein its $Ar^1$ group is directly linked to L and wherein between its $SO_2$ end group and an azo-group of the dye part D only one bivalent aromatic nucleus or bivalent condensed aromatic nucleus, which nuclei may be substituted, is present, and wherein in said group —$Ar^1$—$SO_2NR$—$Ar^2$—$NRSO_2$— R is hydrogen or an alkyl group, and each of $Ar^1$ and $Ar^2$—same or different— represents a bivalent unsubstituted or substituted aromatic nucleus, and/or (2) said group —$Ar^1$—$SO_2NR$—$Ar^2$—$NRSO_2$— is linked directly through its first group $Ar^1$ to an azo-group (—N=N—) of the dye part D, and through its $SO_2$ end group is linked to a group $R^6$

TABLE 7

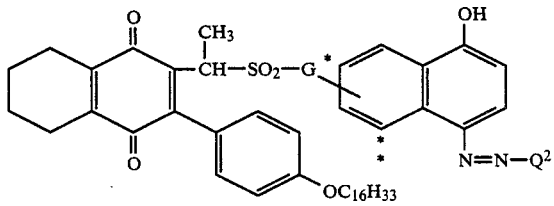

| Comparison compound | G | $Q^2$ |
|---|---|---|
| L | 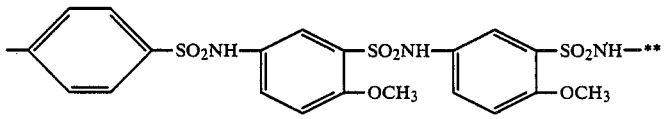 | 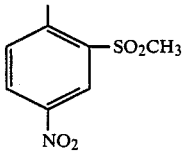 |
| M | 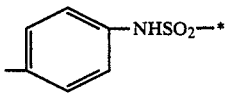 | 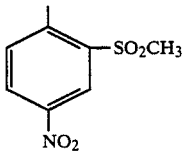 |

We claim:

1. A photographic silver halide emulsionn material for dye image production comprising a support carrying at least one alkali-permeable silver halide hydrophilic colloid emulsion layer having in operative association therewith a non-diffusing dye releasing compound being capable of releasing a diffusible azo dye from a carrier moiety by a redox-reaction which compound corresponds to the following general formula (I):

CAR—L—G—D (I)

which represents hydrogen or an alkyl group, the groups $Ar^1$, $Ar^2$ and R having the same definition as given in point (1) above; wherein the group containing $Ar^1$ and $Ar^2$ does not form part of the group CAR—L—.

2. A photographic material according to claim 1, wherein substituents on the $Ar^1$ and/or $Ar^2$ nucleus are substituents selected from the group consisting of alkyl, halogen, nitro, —cyano, —$OR^3$ or —$SR^3$ wherein $R^3$ represents alkyl or aryl, and the group —$NR^4R^5$, wherein $R^4$ and $R^5$ represent a same or different alkyl group, or represent together the necessary atoms to close a nitrogen containing heterocyclic nucleus.

3. A photographic material according to claim 1, wherein L is $—SO_2—$.

4. A photographic material according to claim 1, wherein said compound corresponds to the following general formula (II):

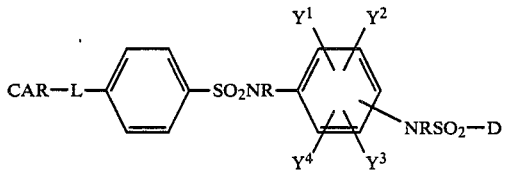

(II)

wherein:

CAR has the meaning as defined in claim 1,

L is —O—, —S—, $—SO_2—$, $—NR^1SO_2—$, $—NR^1CO—$, $—NR^1—$ or a $—N^+R^1R^2—$. ($X^-$) group, wherein each of $R^1$ and $R^2$—same or different when being both present—is hydrogen, an alkyl group, an aryl group, and $X^-$ is an anion, $Y^1$, $Y^2$, $Y^3$ and $Y^4$ —same or different— is hydrogen or a substituent selected from the group consisting of alkyl, halogen, $—OR^3$ or $—SR^3$ wherein $R^3$ represents alkyl or aryl, and the group $—NR^4R^5$, wherein $R^4$ and $R^5$ represent a same or different alkyl group or represent together the necessary atoms to close a nitrogen containing heterocyclic nucleus, R is hydrogen or an alkyl group, the substituents $—SO_2NR—$ and $—NRSO_2$ being situated in ortho- or para-position with respect to each other, and D is an azo dye part either or not substituted by the group $—Ar^1—SO_2NR—Ar^2—NR—SO_2—R^6$ as defined above in connection with general formula (I) of claim 1.

5. A photographic material according to claim 1, wherein said compound is within the scope of the following general formula (III):

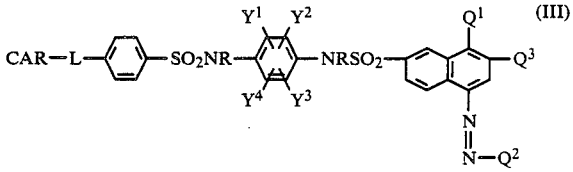

(III)

wherein:

$Q^1$ is OH or hydrolysable precursor thereof, $—NH_2$, $—NHSO_2R^{10}$, $—NHCOR^{10}$ wherein $R^{10}$ is alkyl, $Q^2$ is aryl group or a heterocyclic group, $Y^1$, $Y^2$, $Y^3$ and $Y^4$ —same or different— is hydrogen or a substitutent selected from the group consisting of alkyl, halogen, $—OR^3$ or $—SR^3$ wherein $R^3$ represents alkyl or aryl, and the group $—NR^4R^5$, wherein $R^4$ and $R^5$ represent a same or different alkyl group or represent together the necessary atoms to close a nitrogen containing heterocyclic nucleus, $Q^3$ is H, $—SO_3H$, —COOH, hydrolysable derivatives thereof or salts thereof, $—CONR^{11}R^{12}$, $—SO_2NR^{11}R^{12}$, $—NR^{11}COR^{12}$, $—NR^{11}SO_2R^{12}$, $—COR^{13}$, $—SO_2R^{13}$, wherein each of $R^{11}$, $R^{12}$ and $R^{13}$ —same or different— is hydrogen, an alkyl group, an aryl group or $R^{11}$ and $R^{12}$ together form a heterocyclic ring, and wherein the other symbols CAR— and —L— have the meaning described above in general formula (I) of claim 1.

6. A photographic material according to claim 5, wherein said group $Q^2$ is the group $—Ar^1—SO_2N-R—Ar^2—NRSO_2—R^6$ defined in claim 1 in its point (2).

7. A photographic material according to claim 1, wherein said material comprises a support carrying red-, green- and blue-sensitive silver halide emulsion layers at least one of which has operatively associated therewith a said dye-releasing compound.

8. A photographic material according to claim 1, wherein said photographic material contains in each silver halide emulsion layer a non-diffusible electron donor compound or electron donor precursor compound.

9. A photographic material according to claim 1, wherein said photographic material contains (a) silver halide emulsion layer(s) of the negative-working type.

* * * * *